US009220959B2

(12) United States Patent
Roach et al.

(10) Patent No.: US 9,220,959 B2
(45) Date of Patent: Dec. 29, 2015

(54) GOLF CLUB WITH CELLULAR MASS DISTRIBUTION

(71) Applicant: Cobra Golf Incorporated, Carlsbad, CA (US)

(72) Inventors: Ryan L. Roach, Carlsbad, CA (US); Joshua G. Breier, Vista, CA (US); Douglas E. Roberts, Carlsbad, CA (US); Lauren Wilson, San Jose, CA (US)

(73) Assignee: COBRA GOLF INCORPORATED, Carlsbad, CA (US)

( * ) Notice: Subject to any disclaimer, the term of this patent is extended or adjusted under 35 U.S.C. 154(b) by 159 days.

(21) Appl. No.: 13/946,571

(22) Filed: Jul. 19, 2013

(65) Prior Publication Data

US 2014/0038737 A1 Feb. 6, 2014

Related U.S. Application Data

(60) Provisional application No. 61/678,799, filed on Aug. 2, 2012, provisional application No. 61/764,300, filed on Feb. 13, 2013.

(51) Int. Cl.

| | |
|---|---|
| ***A63B 53/04*** | (2015.01) |
| ***A63B 53/06*** | (2015.01) |
| *A63B 59/00* | (2015.01) |
| *A63B 49/06* | (2006.01) |
| *A63B 71/06* | (2006.01) |

(52) U.S. Cl.

CPC ..... *A63B 53/047* (2013.01); *A63B 53/04* (2013.01); *A63B 49/06* (2013.01); *A63B 53/06* (2013.01); *A63B 59/0092* (2013.01); *A63B 2053/0454* (2013.01); *A63B 2053/0491* (2013.01); *A63B 2071/0694* (2013.01)

(58) Field of Classification Search

CPC ..... A63B 53/047; A63B 53/04; A63B 53/06; A63B 59/0092; A63B 49/06; A63B 2071/0694; A63B 2053/0491; A63B 2053/0454

USPC ..... 473/324–350, 287–292

See application file for complete search history.

(56) References Cited

U.S. PATENT DOCUMENTS

| | | | | |
|---|---|---|---|---|
| 922,444 | A | 5/1909 | Youds | |
| 1,133,129 | A | 3/1915 | Govan | |
| 1,518,316 | A | 12/1922 | Ellingham | |
| 1,840,924 | A | 1/1932 | Tucker | |
| 2,163,091 | A | 6/1939 | Held | |
| 3,084,940 | A | 4/1963 | Cissel | |
| 3,652,094 | A | 3/1972 | Glover | |
| 3,845,960 | A | 11/1974 | Thompson | |
| 3,847,399 | A * | 11/1974 | Raymont | 473/350 |
| 3,979,122 | A | 9/1976 | Belmont | |
| 3,979,123 | A | 9/1976 | Belmont | |
| 4,076,254 | A | 2/1978 | Nygren | |
| 4,195,842 | A | 4/1980 | Coleman | |

(Continued)

*Primary Examiner* — Sebastiano Passaniti

(74) *Attorney, Agent, or Firm* — Brown Rudnick LLP; Mark S. Leonardo

(57) ABSTRACT

The invention relates to golf club heads with improved mass distribution provided by novel cellular features. Because a club head can have very low mass density in certain parts, the club head can have much more mass in other parts, while keeping the overall club head mass equal to the mass of prior art club heads. A club head can be provided with optimized MOI and CG. The novel cellular structures of invention provide extensible functionality in the form of pockets, recesses, and windows and provide materials with excellent strength and restitution properties.

13 Claims, 24 Drawing Sheets

(56) References Cited

U.S. PATENT DOCUMENTS

| | | | | | |
|---|---|---|---|---|---|
| 4,206,924 | A | | 6/1980 | Koralik | |
| 4,340,230 | A | * | 7/1982 | Churchward | 473/339 |
| 4,607,846 | A | | 8/1986 | Perkins | |
| 4,681,322 | A | | 7/1987 | Straza et al. | |
| 4,754,977 | A | * | 7/1988 | Sahm | 473/337 |
| 4,883,274 | A | * | 11/1989 | Hsien | 473/335 |
| 4,930,781 | A | * | 6/1990 | Allen | 473/346 |
| 4,962,932 | A | | 10/1990 | Anderson | |
| 5,013,041 | A | | 5/1991 | Sun et al. | |
| 5,050,879 | A | | 9/1991 | Sun et al. | |
| 5,246,227 | A | * | 9/1993 | Sun et al. | 473/337 |
| 5,301,941 | A | * | 4/1994 | Allen | 473/327 |
| 5,318,300 | A | | 6/1994 | Schmidt et al. | |
| 5,330,187 | A | | 7/1994 | Schmidt et al. | |
| 5,358,249 | A | | 10/1994 | Mendralla | |
| 5,385,348 | A | | 1/1995 | Wargo | |
| 5,401,021 | A | * | 3/1995 | Allen | 473/291 |
| 5,489,097 | A | | 2/1996 | Simmons | |
| 5,564,705 | A | * | 10/1996 | Kobayashi et al. | 473/334 |
| 5,588,923 | A | * | 12/1996 | Schmidt et al. | 473/340 |
| 5,599,243 | A | | 2/1997 | Kobayashi | |
| 5,688,189 | A | | 11/1997 | Bland | |
| 5,711,722 | A | | 1/1998 | Miyajima et al. | |
| 5,735,755 | A | | 4/1998 | Kobayashi | |
| 5,776,010 | A | * | 7/1998 | Helmstetter et al. | 473/334 |
| 6,007,432 | A | | 12/1999 | Kosmatka | |
| 6,015,354 | A | * | 1/2000 | Ahn et al. | 473/256 |
| 6,077,171 | A | * | 6/2000 | Yoneyama | 473/291 |
| 6,093,112 | A | * | 7/2000 | Peters et al. | 473/291 |
| 6,238,302 | B1 | | 5/2001 | Helmstetter et al. | |
| 6,264,571 | B1 | | 7/2001 | Lekavich | |
| 6,290,609 | B1 | * | 9/2001 | Takeda | 473/335 |
| 6,319,150 | B1 | | 11/2001 | Werner et al. | |
| 6,406,382 | B1 | * | 6/2002 | Deshmukh et al. | 473/349 |
| 6,428,426 | B1 | | 8/2002 | Helmstetter et al. | |
| 6,485,375 | B1 | | 11/2002 | McKinley | |
| 6,592,468 | B2 | | 7/2003 | Vincent et al. | |
| 6,616,547 | B2 | | 9/2003 | Vincent et al. | |
| 6,638,183 | B2 | | 10/2003 | Takeda | |
| 6,773,361 | B1 | * | 8/2004 | Lee | 473/335 |
| 6,835,144 | B2 | | 12/2004 | Best | |
| 6,923,734 | B2 | | 8/2005 | Meyer | |
| 6,932,716 | B2 | | 8/2005 | Ehlers et al. | |
| 6,962,538 | B2 | | 11/2005 | Roach et al. | |
| 6,971,960 | B2 | | 12/2005 | Dewanjee et al. | |
| 7,083,530 | B2 | * | 8/2006 | Wahl et al. | 473/334 |
| 7,083,531 | B2 | * | 8/2006 | Aguinaldo et al. | 473/350 |
| 7,101,288 | B2 | * | 9/2006 | Thomas | 473/242 |
| 7,144,334 | B2 | | 12/2006 | Ehlers et al. | |
| 7,153,222 | B2 | * | 12/2006 | Gilbert et al. | 473/349 |
| 7,192,365 | B2 | * | 3/2007 | Souza et al. | 473/329 |
| 7,311,612 | B2 | | 12/2007 | DeLucia | |
| 7,507,167 | B2 | | 3/2009 | Roach et al. | |
| D598,060 | S | * | 8/2009 | Barez et al. | D21/747 |
| 7,713,140 | B2 | | 5/2010 | Gibbs et al. | |
| 7,722,479 | B2 | | 5/2010 | Soracco | |
| 7,771,288 | B2 | | 8/2010 | Gilbert et al. | |
| 7,803,064 | B2 | | 9/2010 | Roach et al. | |
| 7,871,338 | B2 | * | 1/2011 | Nakano | 473/332 |
| 7,998,001 | B2 | | 8/2011 | Soracco | |
| 8,083,610 | B2 | | 12/2011 | Roberts et al. | |
| 8,147,353 | B2 | | 4/2012 | Gilbert et al. | |
| 8,157,673 | B2 | | 4/2012 | Gilbert et al. | |
| 8,172,701 | B2 | | 5/2012 | Soracco | |
| 8,282,506 | B1 | * | 10/2012 | Holt | 473/350 |
| 8,376,878 | B2 | | 2/2013 | Bennett et al. | |
| 8,663,027 | B2 | | 3/2014 | Morales et al. | |
| D709,149 | S | * | 7/2014 | Roach et al. | D21/747 |
| 2002/0061788 | A1 | | 5/2002 | Marcase | |
| 2003/0119602 | A1 | | 6/2003 | Kennedy et al. | |
| 2003/0139226 | A1 | | 7/2003 | Cheng et al. | |
| 2003/0228932 | A1 | | 12/2003 | Ehlers et al. | |
| 2004/0009829 | A1 | | 1/2004 | Kapilow | |
| 2005/0202899 | A1 | * | 9/2005 | Roach et al. | 473/332 |
| 2005/0272528 | A1 | | 12/2005 | Ehlers et al. | |
| 2006/0166758 | A1 | | 7/2006 | Roberts et al. | |
| 2006/0172816 | A1 | | 8/2006 | Johnson | |
| 2007/0178988 | A1 | | 8/2007 | Tavares et al. | |
| 2008/0020861 | A1 | | 1/2008 | Adams et al. | |
| 2009/0305815 | A1 | | 12/2009 | Hirano | |
| 2011/0159987 | A1 | | 6/2011 | Takechi et al. | |
| 2011/0275453 | A1 | | 11/2011 | Tavares et al. | |
| 2012/0190478 | A1 | * | 7/2012 | Roach et al. | 473/332 |
| 2012/0258820 | A1 | | 10/2012 | Roach et al. | |
| 2013/0065706 | A1 | | 3/2013 | Park et al. | |
| 2013/0267345 | A1 | * | 10/2013 | Roach | 473/332 |

* cited by examiner

2901

| | | | |
|---|---|---|---|
| A | 4i | 4i, 5i | 4i |
| B | 5i | 6i | 5i |
| C | 6i, 7i, 8i | 7i, 8i | 6i, 7i |
| D | 9i | 9i | 8i, 9i |
| E | PW | PW, GW | PW |
| F | GW, SW, LW | SW, LW | GW, SW |

FIG. 29

GOLF CLUB WITH CELLULAR MASS DISTRIBUTION

CROSS-REFERENCE TO RELATED APPLICATION

This application is a non-Provisional claiming the benefit of, and priority to, both U.S. Provisional Patent Application Ser. No. 61/678,799, filed Aug. 2, 2012, and U.S. Provisional Patent Application Ser. No. 61/764,300, filed Feb. 13, 2013, the contents of each of which are incorporated by reference in their entirety.

FIELD OF THE INVENTION

The invention relates to golf club heads with improved mass distribution provided by novel cellular features.

BACKGROUND

When a golfer makes a shot, he or she typically wants the golf ball to travel a certain distance in a certain direction. Unfortunately, when a golfer makes a shot, the ball will sometimes travel in an unintended direction or not travel the desired distance. Existing approaches to correcting for off-center shots or tuning distance have included designing a club's mass distribution to increase moment of inertia or locate a club head center of gravity with specificity. However, these approaches are limited by the other demands on a club head. Because a club head must withstand thousands of high-impact hits, parts of the club head body and face cannot simply be made thinner. If the face or part of the club head body were simply made very thin, the club head would crack and fail soon after a golfer bought it. This would make a golfer unhappy.

SUMMARY i. Cells

The invention provides a golf club head with cellular mass distribution that allows mass to be distributed in a club head without compromising structural integrity. The club head includes cells defined by structural elements that give the club head strength, even where the cells are empty or occupied by other materials. The structural elements can operate as supporting walls to define the cells, and the cells can be left empty, can be filled, or can be "outie" cells from which material protrudes. Cells can be filled with or occupied by low density or neutral materials, weights, mixed materials, or materials that offer functional benefits such as elastic dampening. Because materials of any density may be distributed among any number of cells, each club head can have an optimized mass distribution for the purpose of that club head. Since the structural elements provide strength throughout the club head, the club head is durable and withstands intense use.

By providing a club head with a very low mass per unit volume near a topline or crown and a much higher mass per unit volume near a heel or a toe, a club head can have a very high moment of inertia. By having a high mass per unit volume near a sole, a club head can have a very low center of gravity.

Since a club head of the invention has a high MOI, it does not twist in space during off center hits. As a results, even off-center shots tend to send the ball in the intended direction.

Since a club head of the invention may have a very low center of gravity, it can impart high momentum to the golf ball, causing the ball to travel the intended distance. Since shots made with a golf club of the invention travel the intended direction and the intended distance, a golfer will consistently make the shots they desire to make. As a result, a golfer will experience very excellent results and benefits by playing with a club of the invention.

In some aspects, the invention provides a golf club head with a body and a face connected to the body, in which the face has a variable thickness provided by one or more cells, or recessed areas into the material of the face (e.g., on a back surface of the face). The cells may form a regular repeating pattern (e.g., like honeycomb or brickwork).

Aspects of the invention provides a golf club head with a body attached to a face, and having a medallion member inserted therein, wherein a portion of the medallion is visible inside of a cavity within the back of the body, and a portion of the medallion is visible through a window that is beneath the cavity when the club is at address. The medallion may be a polymer or a viscoelastic material such as, for example, TPU or a plastic or rubber material. The medallion may be colored, transparent, translucent, or opaque and may have indicia providing information (e.g., describing other features of the club head). The window through the metal body of the club head makes the indicia easy to find in a crowded golf bag.

In some aspects, the invention provides a golf club head with a body that includes a face insert opening for attachment of a face insert. The body has one or more pockets or cells therein accessible through the face insert opening (i.e., so that the pockets or cells are covered and concealed when the face insert is installed onto the body). The club head may include at least one insert member in the one or more pockets.

In related aspects, the invention provides a golf club head with a main body with a toe side, a heel side, a sole portion, and a top portion; a hosel extending from the heel side; and a ball striking face insert supported by an attachment perimeter defining an aperture through the main body. The club head includes one or more cells defining recesses into the body member and only accessible through the aperture.

In some aspects, the invention provides a golf club head having a main body with a toe side, a heel side, a sole portion, and a top portion. A hosel extends from the heel side and a ball striking face member is supported by the main body. The club head includes a plurality of cells with varying depths including both innie and outie cells. In some embodiments, all of the plurality of cells have substantially similar shapes and occupy a substantially similar area of the club head. In certain embodiments, the plurality of cells define a regular repeating pattern.

ii. Inserts

Additionally, facets of the invention provide cell inserts that can be set or customized by a user or by a golf pro or instructor. For example, a club head can include heel-side and toe-side cells and inserts that fit into those cells. The user can bias the mass distribution according to their druthers or a club provider can optimize the mass distribution prior to sending the club home with the user. Optionally, a club head may include a cover or plate to enclose the cells—either user-removable or fixed in place.

The invention further includes the insight that mass distribution can have a maximal effect on MOI where inserts are shaped and located with a particular relationship to one or more rotational axes. Weight inserts that have mass concentrated within a cylindrical shell defined by an outer radius and an inner radius of a rotational axis will increase MOI more than equivalent masses that extend substantially within the inner radius. Inserts that have regular geometric shapes such as arcs or parallelograms provide for ease of insertion and also can concentrate their mass within a cylindrical shell if oriented in certain ways. Insert sets of the invention can be set by a club provider or adjusted by a user to optimize MOI, particularly where the inserts and the corresponding cells are configured with shapes that concentrate within a cylindrical shell concentric with a relevant rotational axis such as, for example, an axis that is vertical when the club head is at address.

In certain aspects, the invention provides a golf club head having a body with a top line, a heel portion, a toe portion, and a sole portion. A hosel extends up from the heel portion and a ball striking face is supported by the body. A back portion extends between the heel portion and the toe portion and up from the sole portion. The club head includes a plurality of recesses into the back portion and an insert disposed within each of the plurality of recesses. Preferably, the plurality of recesses includes at least a recess into the heel portion and a recess into the toe portion. The plurality of recesses may include two outer recesses flanking two inner recesses, the four recesses being distributed along the back portion. In some embodiments, the plurality of recesses comprises at least two outer recesses, each of the two outer recesses having a shape that is substantially a mirror image of the a shape of the other one. The club head may be a cavity back club with an undercut—i.e., at least part of the back portion is spaced away from a back of the ball striking face to define an undercut in communication with a cavity in a back of the club head.

Preferably, each recess and each insert has a skewed shape comprising faces that are not orthogonal to one another, oriented to concentrated a majority of the mass of each insert into a cylindrical shell coaxial with an axis of rotation of the club head that is vertical when the club head is at address. One, some, or all of the faces may be planar. In some embodiments, at least one of the inserts has a parallelepiped shape. Each insert may be dimensioned to be inserted into the recess into the heel portion and removed and rotated and insert into the recess into the toe portion.

A surface of each insert may be mounted to the club head through an adhesive. In some embodiments, the adhesive connects to the insert through a viscoelastic dampening layer.

iii. Speed channel

A further discovery and application of facets of the invention includes the insight that providing a channel at a base of a back of a ball-striking face may greatly increase ball speed and reduce materials fatigue in what was, in the prior art, a common place of breakage. A channel, or groove, near the sole (e.g., within an undercut of a cavity in a cavity-back iron) provides a smooth transition allowing face flexure and gives a club head without a substantial material discontinuity. This channel may prevent breakage by allowing greater flexure and also increase a club face coefficient of restitution, thus greatly increasing ball speed and distance.

Aspects of the invention provide a golf club head having a body with a toe side, a heel side, a sole portion, and a top portion; a hosel extending from the heel side; a ball striking face member supported by the main body; and a channel in a surface of the sole and adjacent to a back surface of the face member. The channel may have a semi-circular cross-section and may extend from heel to toe. In some embodiments, the channel is in an upward-facing, inner surface of the sole. The channel may have a maximum cross-sectional dimension between about 0.5 mm and about 4 mm.

In certain embodiments, the ball striking face member is a face insert comprising a first material and the body comprises a second material. Further, the club head may include one more recesses into a back side of the body. The club head may also include a set of inserts of varying densities dimensioned to fit into the recesses.

BRIEF DESCRIPTION OF THE DRAWINGS

FIG. 29 illustrates a flow set.

DETAILED DESCRIPTION

Figure 1:
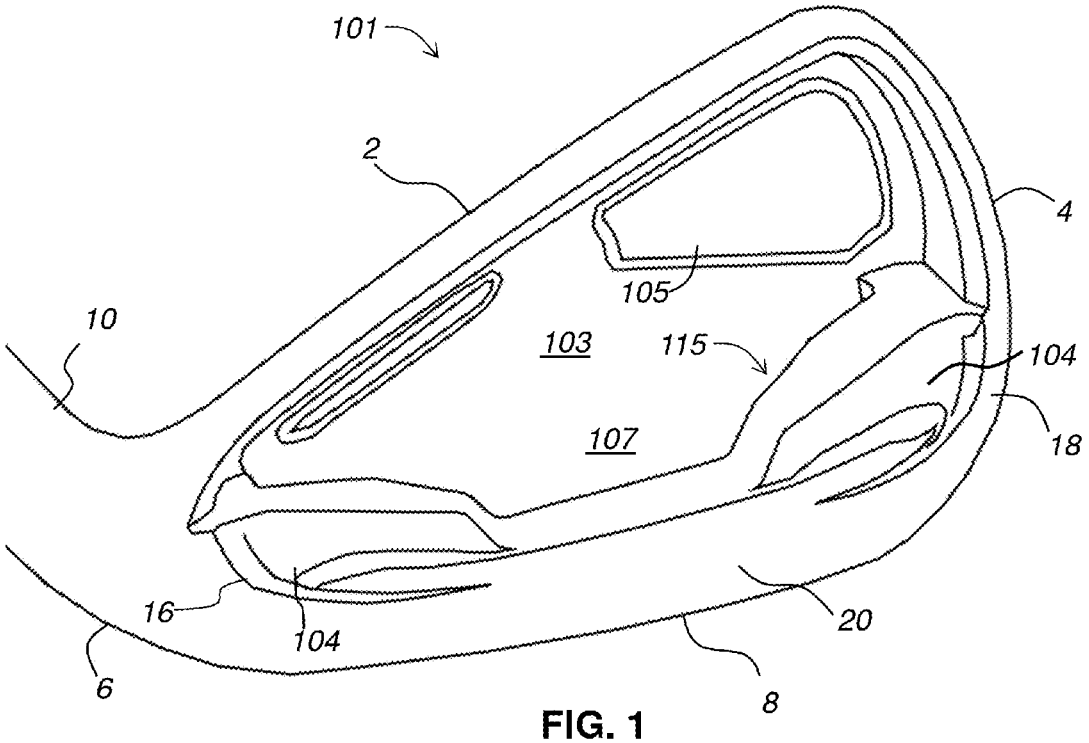
FIG. 1 shows a club head with innie cells and perimeter masses.

FIG. 1 depicts an embodiment of an iron-type golf head 101 including a cell structure. Club head 101 is, in some embodiments, constructed as a perimeter weighted cavity back golf club head with a perimeter body, a hosel 10, at least one cell member 105 and a face panel 103.

The perimeter body includes a top line 2, a toe portion 4, a heel portion 6, and a sole portion 8 and provides mass distribution of golf club head 101 that increases the moment of inertia by concentrating the mass of the club head at the perimeter of face panel 103. Sole portion 8 may further include mass concentrations to further tune the mass properties of club head 1. For example, in the present embodiment, sole portion 8 includes a heel mass 16 and a toe mass 18 and a back portion 20. Back portion 20 is spaced away from a back of face insert 103 to create an undercut 115. A center of back portion 20 has a reduced height that combines with heel mass 16 and toe mass 18 to increase the moment of inertia about a Y-axis extending through the center of gravity of golf club head 101.

Face panel 103 is disposed on the perimeter body and provides a front ball striking surface. Face panel 103 may have an overall equivalent thickness, e.g., between about 1.5 mm and about 4.0 mm while also having a variable thickness defined by cells. For example, the face may have regions of greater thickness provided as an outie cell 107. Additionally, face panel 103 may be formed integral with perimeter body or as a separate component that is coupled to the perimeter body. Face insert construction is discussed in U.S. Pat. No. 7,771,288; U.S. Pub. 2013/0065706; U.S. Pub. 2012/0258820; and U.S. Pub. 2003/0119602, the contents of which are incorporated by reference. Face panel 103 may be constructed from the same or a different material than the perimeter body and hosel 10, and it combines with the perimeter body to define a rear cavity.

The invention provides cell structures that alter the perimeter body to free up or to consume discretionary mass. As shown in FIG. 1, an inward-opening cells 104 may decrease mass on a high-mid portion of a back member and thus may lower a position of a club head center of gravity in a direction that is vertical when the club head is at address (an outward-facing cell could increase mass). The discretionary mass may be dedicated to alter the mass characteristics of the golf club head, such as by using it to lower the location of the center of gravity or to increase the moment of inertia. Additionally, some of that discretionary mass may be utilized in the construction of other features. Club head constructions are discussed further in U.S. Pat. No. 8,157,673; U.S. Pat. No. 6,835,144; and U.S. Pub. 2004/0009829, the contents of which are incorporated by reference in their entirety for all purposes.

Hosel 10 is disposed on a heel end of face 14 and the perimeter body, and provides an attachment to a shaft so that club head 101 may be assembled into a complete golf club. Hosel 10 may be constructed integral with face 14 and/or the perimeter body. Hosel 10 may also be constructed from the same, or a different, material than face 14 and/or the perimeter body.

The invention generally provides club heads with optimized mass distribution properties. An approach to distributing mass involves the placement of cells in or on the surfaces of club head materials. Cells can be recessed or protruding areas of material having less or more, respectively, material than the surrounding areas.

FIG. 1 shows a club head 101 with an innie cell 104 on the back of the club head body at a toe end as well as at a heel end. Further, the strike face has heel and toe-side innie cells 105 on the back surface. Each cell decreases the mass of material, relative to a smooth-surfaced club head. However, the strength of the material is not decreased too drastically due to the structure of the cells. Compared to club head components that are simply thinner, cell-surfaced materials are stronger. Without being bound by any mechanism, it is theorized that the areas at the perimeter of the cells provide thicker zones (i.e., the cell walls) that confer strength and rigidity to the parts.

Figure 2A:
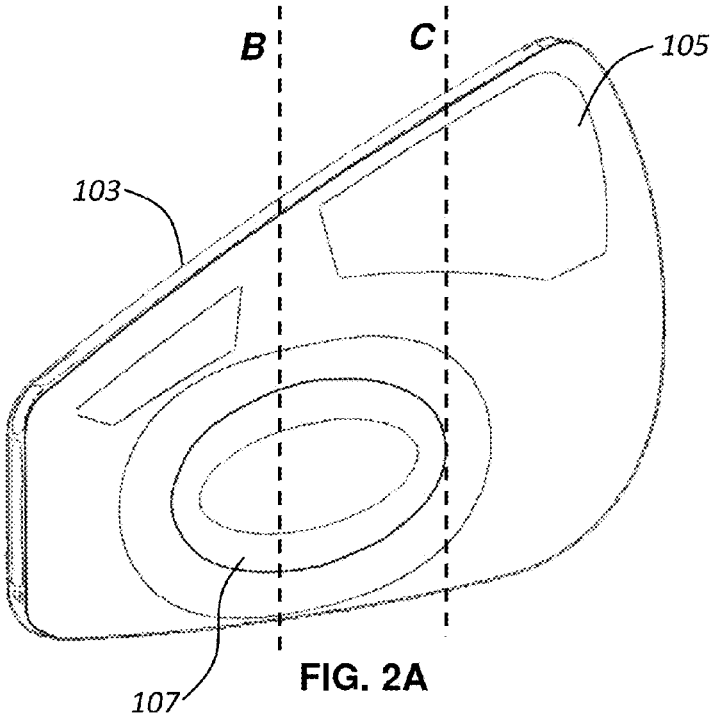
FIG. 2A shows a face insert according to certain embodiments.

FIG. 2A shows a face insert 103 having multiple innie cells 105 and an outie cell 107. Face insert 103 has a contoured back surface defining cells, or zones of different thickness. Good strength and a coefficient of restitution is conferred by the structure. For example, a boundary between the innie cells and the neutral-thickness area extends from a central area of the face insert towards a periphery of the face insert. In this manner, the neutral thickness area between the two innie cells 105 provides a spoke-like structure, or a radiating arm having a thickness greater than the area bounded by the perimeters of cells 105. Studying FIG. 2 reveals that the outie cell 107—i.e., the thick area—is surrounded by areas of face insert 103 of neutral thickness that radiate to the outer perimeter of face insert 103. It is believed that these neutral thickness areas, the boundaries between the cells and the neutral thickness areas, or both, confer good strength on face insert 103.

Figure 2B:
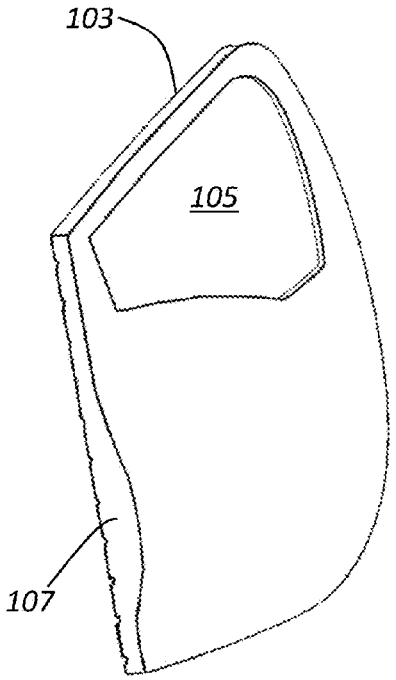
FIGS. 2B and 2C show cross sectional views through a face insert.
Figure 2C:
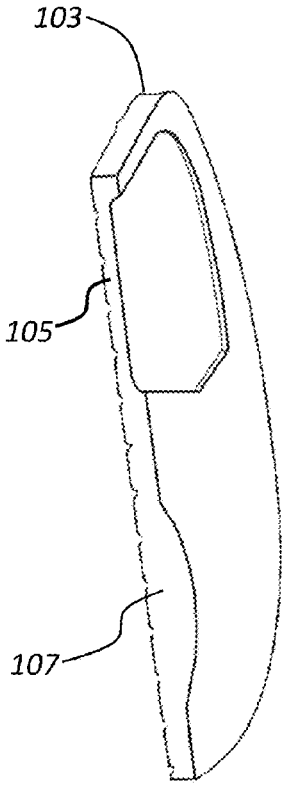

FIGS. 2B and 2C show cross sectional views through face insert 103, showing that outie cell 107 defines a region of increased thickness and innie cell 105 defines a region of minimal thickness. Outie cell 107 may provide additional mass for tuning mass properties of a club head, additional strength to prevent fatigue and failure of the face insert, material conferring a good coefficient of restitution, or a combination thereof. An outie cell, or thick zone, can have any suitable shape, such as an ellipse or oval. Other shapes and sizes of zones than those illustrated are also possible. For example, in some embodiments the zones can have a rhombus-like shape, or other shape. Thickness of face inserts is discussed in U.S. Pat. No. 8,147,353; U.S. Pat. No. 7,713,140; U.S. Pat. No. 6,428,426; U.S. Pat. No. 6,007,432; U.S. Pat. No. 5,318,300; and U.S. Pub. 2011/0159987, the contents of which are hereby incorporated by reference in their entirety for all purposes.

In some embodiments, face insert 103 having a combination of cells provides a club head with a greater coefficient of restitution than would otherwise be possible if the face insert 103 had a constant thickness. In some embodiments, club head 103 has a coefficient of restitution that ranges from approximately 0.825-0.855 while maintaining acceptable durability of the face. In some embodiments, the club head 103 can have a coefficient of restitution that ranges from approximately 0.800 to 0.900. Other ranges and values are also possible.

Figure 3:
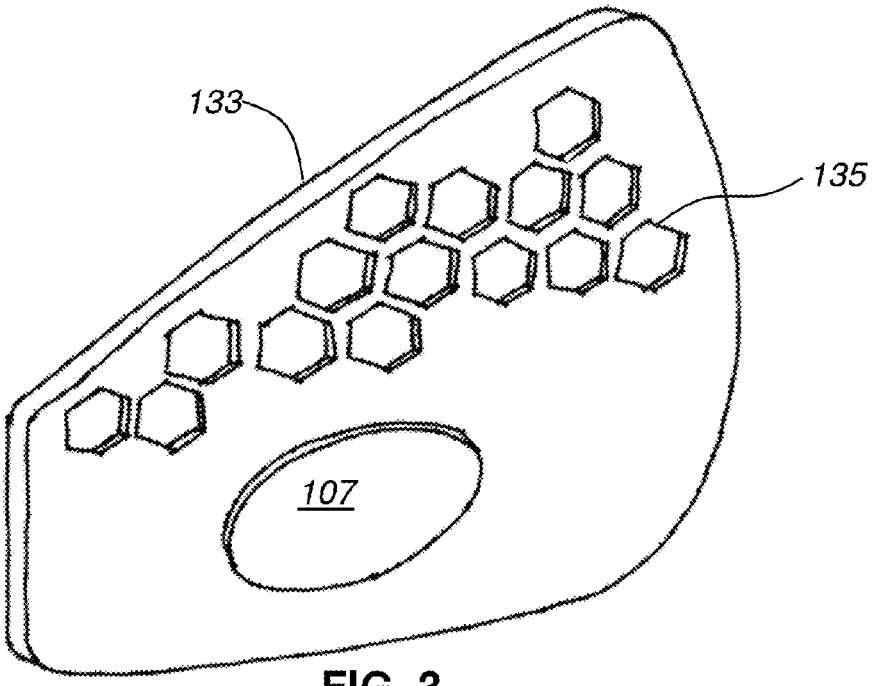
FIGS. 3 and 4 show face inserts according to certain embodiments.

FIG. 3 shows a face insert 133 with an outie cell 107 and a repeating pattern of hexagonal innie cells 135. Hexagonal shapes allow for a tessellating geometric pattern that minimizes a ratio of edge to cell area. Geometric patterns or geometric patterns with rounded corners may be preferred for ease of manufacturing with standard end mill machinery. Tessellation of cells may be preferred for optimizing both strength of the piece and mass reduction or increase provided by the cells. Regular tessellation as depicted, for example, in FIG. 3 may be preferred for ease of manufacturing. It may be preferable to minimize a ratio of edge to cell area to maximize strength or rigidity of the piece. Low edge to area ratios may be provided by shapes that exhibit regular tessellation (hexagons, squares, diamonds, triangles, rectangles, etc.) or by tightly packed shapes such as circles or ovals.

Figure 4:
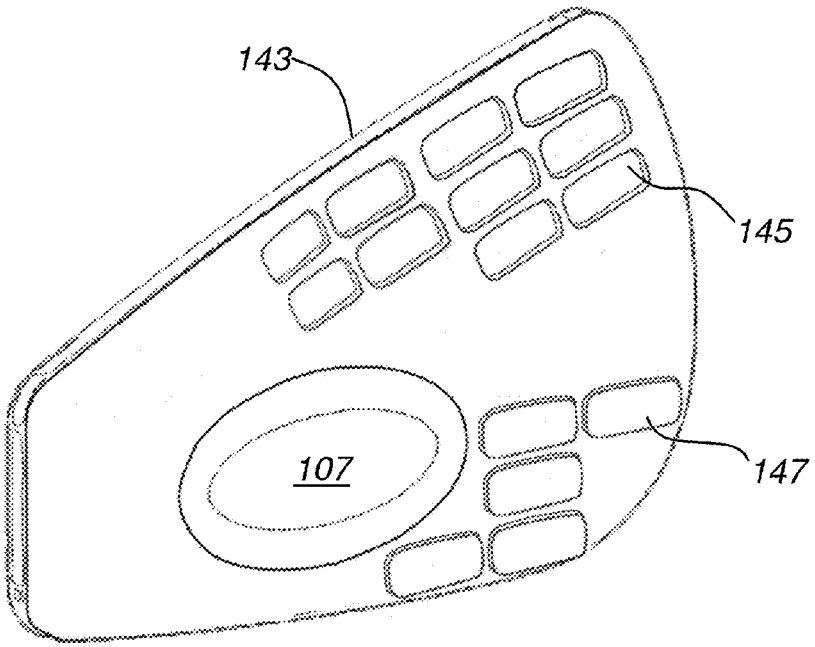

FIG. 4 shows a face insert 143 with an outie cell 107, a repeating pattern of oblong innie cells 145, and a number of oblong outie cells 147. As shown by FIGS. 3 and 4, cell patterns allow the selected removal and redistribution of material to tune the mass distribution properties of a face insert or a club head (i.e., mass can be removed from a face insert, for example, by one or more innie cells and added elsewhere on a club head, for example, as tungsten weight members in the sole). Selective removal of patterns of material from a surface provide pieces of material that are lighter than pieces with smooth surfaces. Material can be removed in a cell pattern or similar. A cell pattern can include cells, where cells are portions of material removed from a surface of a material to create hollows or divots. A cell can have straight-down walls, angled-in walls, cutaway walls, or irregular walls. A cell is generally a recessed space in a surface, protruding into the material (i.e., a recessed opening). A cell pattern includes one or more cells. Cells in a pattern can be similar in size, shape, or both, and can be arranged in a repeating pattern. For example, cells can have a shape that can be tessellated, such as rectangle or hexagon, and can be tessellated together on the surface of the material.

Selective removal of cells of material can decrease the weight of the material without substantially decreasing the strength or rigidity. Cell size and depth can be optimized to provide a material that is lightweight, strong, and has a desired rigidity. Pieces of material with cell patterns function as though they were the same thickness as smooth sheets of material. They provide strength and flexibility/restitution properties as well as, or better than, smooth pieces of material of functionally equivalent thickness. Cell-surfaced materials can exhibit greater springiness and resistance to bending or deformation than expected, while being surprisingly light. Forging, routing, CNC milling, molding, and embossing, for example, provide inexpensive methods for manufacturing cell-surfaced material. Club head structures are discussed in U.S. Pat. No. 6,319,150; U.S. Pat. No. 5,735,755; U.S. Pat. No. 5,711,722; and U.S. Pat. No. 4,681,322, the contents of which are incorporated by reference herein in their entirety for all purposes.

In certain embodiments, each innie cell is a hole through more than about 10% of the thickness of the material. Greater weight savings are had by deeper cells so, in some embodiments, each cell is a hole through more than about 25% of the thickness of the material (e.g., more than about 50% of the thickness). In very light-weight embodiments, each cell is a hole through more than about 75% of the thickness of the material. In strength-optimized, each cell is a hole through about 30% to about 70% of the thickness of the material.

Figure 5A:
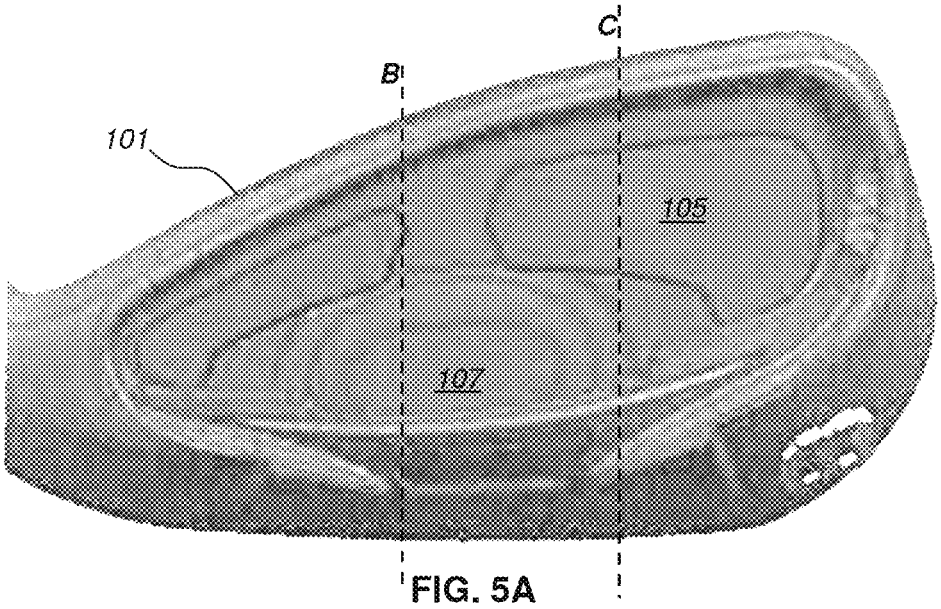
FIG. 5A shows a club head face that includes innie and outie cells on the back surface.

FIG. 5A is a back view of a club head 101 according to certain embodiments. Club head 101 has two innie cells 105 and an outie cell 107 on a back surface of the striking face.

Figure 5B:
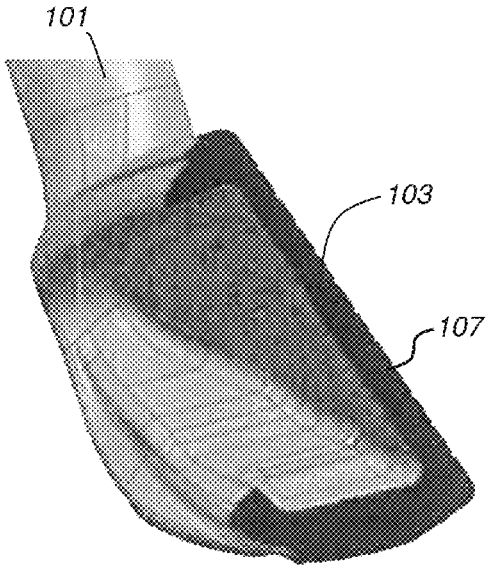
FIG. 5B is a cross-sectional view of the club head shown in FIG. 5A along line B.
Figure 5C:
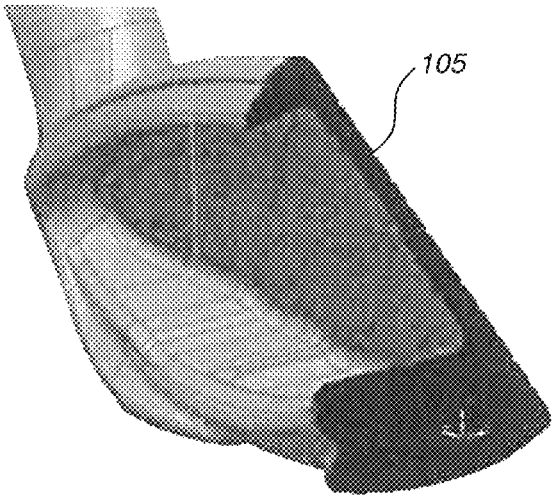
FIG. 5C is a cross-sectional view of the club head shown in FIG. 5A along line C.

FIGS. 5B and 5C are cross sectional view of club head 101 along lines B and C, respectively, of FIG. 5A. These views show the varying thickness of the ball-striking face of club head 101.

In certain aspects, the invention provides club heads with inserts and methods of attaching inserts to club heads. Attachment according to the invention allows for attaching inserts to club heads of dissimilar materials (i.e., two materials that can or cannot be welded together). The invention provides pockets for inserts that give a club designer control over the visibility of an insert in a finished club and the ability to add inserts with or without welding.

In some embodiments, the invention provides a club head body with one or more pockets for receiving an insert through the face area of a club head body.

Figure 6:
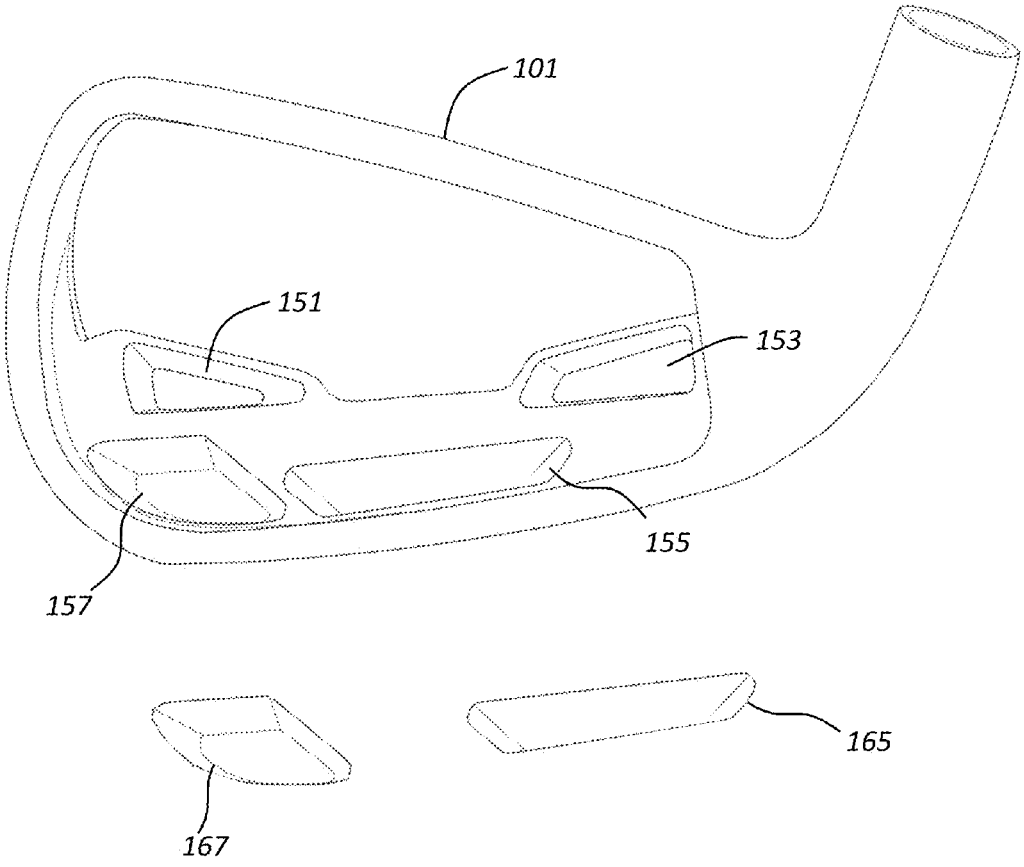
FIG. 6 shows a club head body with recesses that get covered by a face insert.

FIG. 6 shows a club head body 101 with pockets accessible through the face area. A toe pocket 151, a heel pocket 153, a sole pocket 155, and a sole-toe pocket 157 are depicted, although any combination of pockets are possible. Also shown are insert 167 for pocket 157 and insert 165 for pocket 155 (inserts for pockets 151 and 153 are not depicted in FIG. 6). Each pocket can be used to accommodate an insert with a density that is the same as, greater than, or lower than, the surrounding material of the club head body 101. To illustrate, sole pocket 155 can be provided with sole insert 165 and sole-toe pocket 157 can be provided with sole-toe insert 167. In this way, a neutral club can be provided with inserts of the same density as the club head body. In the alternative, sole pocket 155 and sole-toe pocket 157 can be filled with high-density inserts to lower a club head CG and increase a MOI. Recess structures are discussed in U.S. Pat. No. 7,803,064 and U.S. Pat. No. 5,330,187, the contents of which are hereby incorporated by reference in their entirety for all purposes.

A significant benefit of pockets with through-face access is that inserts may be added easily during manufacture, but made not visible in a finished club head. Many irons are made with a body member that is attached to a separate face insert. Through-face pockets capture dual additional functionalities from the face insert by using the attachment of the face insert to retain insert members as well as to conceal them.

In certain aspects, the invention provides a club head with a window for showing, for example, a medallion material, a word or other indicia, an inside of a club head cavity, or a combination thereof. A window allows a club manufacturer to customize a cell-based club head and then provide indicia communicating the function of the particular club in a location that is fixed into a regular and expected location. The window provides a benefit in the form of emphasis and regularity for the useful piece of information. Since a golfer may become accustomed to glancing at clubs in a bag and looking for informative indicia in the regular and expected spot, and since a window can contrast usefully with the surrounding material, the golfer can select the right club rapidly with ease. For example, two clubs that are alike but for heel versus toe cell weighting in each may have an indicia in the window of each, one of which says "fade" and the other of which says "draw".

Figure 7:
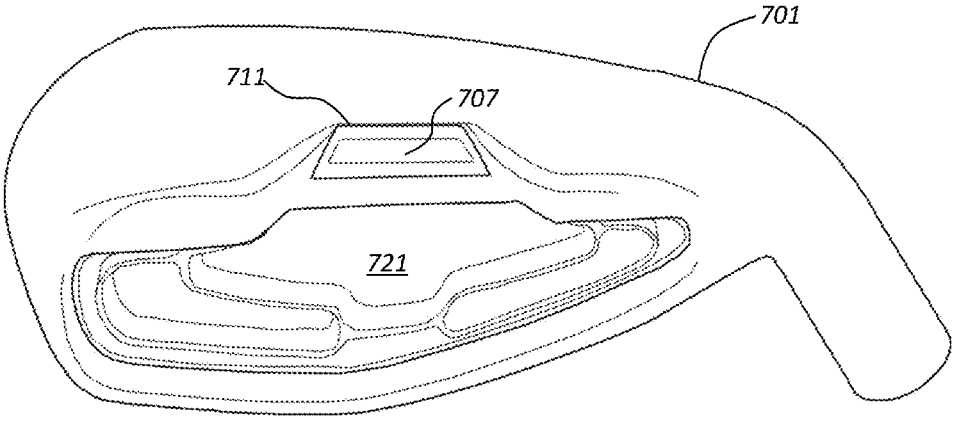
FIG. 7 shows a club head with a window in the body.

FIG. 7 shows a club head 701 with a window 711 in the sole area with a medallion 707 part of an insert 721 visible through the window 711.

Figure 8:
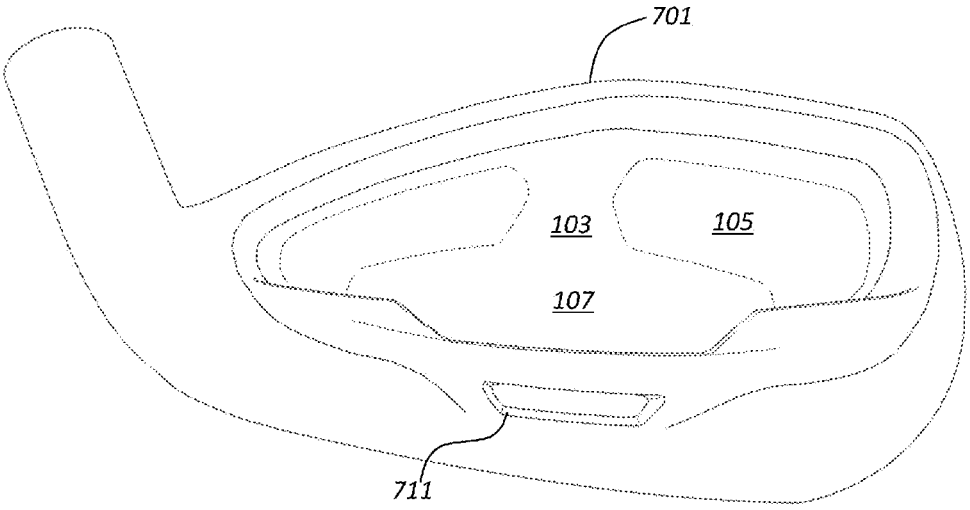
FIG. 8 shows the club head of FIG. 7, without the insert, showing cells.

FIG. 8 shows club head 701 without insert 721, showing cells in the back of the face. A club head body like that shown in FIG. 8 can be designed and dimensioned to receive an insert. The insert 721 can be a polymer such as a thermoset polymer like thermoplastic polyurethane. Insert 721 may have a descending member to provide or include a medallion 107 that can be visible when insert 721 is inserted in club head 701.

In certain embodiments, insert 721, or medallion portion 107, is opaque, translucent, or transparent. Where the portion is translucent or transparent, an inside part of club head 701 may be visible or partially visible through window 711. This provides information to a golfer about materials, design, and construction of the club head. In this way, the invention surmounts existing challenges about communicating to golfers the features and functions of their club heads. In prior art clubs, two club heads may have significantly different mass distributions or playability characteristics but may appear exactly the same to a golfer. Here, where club heads of the invention have distinct mass distributions, the invention provides mechanisms for revealing aspects of the materials to a golfer in a controlled, even understated, fashion. For example, a transparent insert will allow a golfer to observe the different mass distributions through window 711.

Further, the invention provides windows for the display of mechanisms such as inserts in the pockets shown and discussed with reference to FIG. 6. While the pockets discussed with reference specifically to FIG. 6 can be provided to conceal entirely an insert within an assembled club head, in some embodiments, a pocket conceals an insert partially while also revealing, in a controlled manner, part of an insert.

Figure 9:
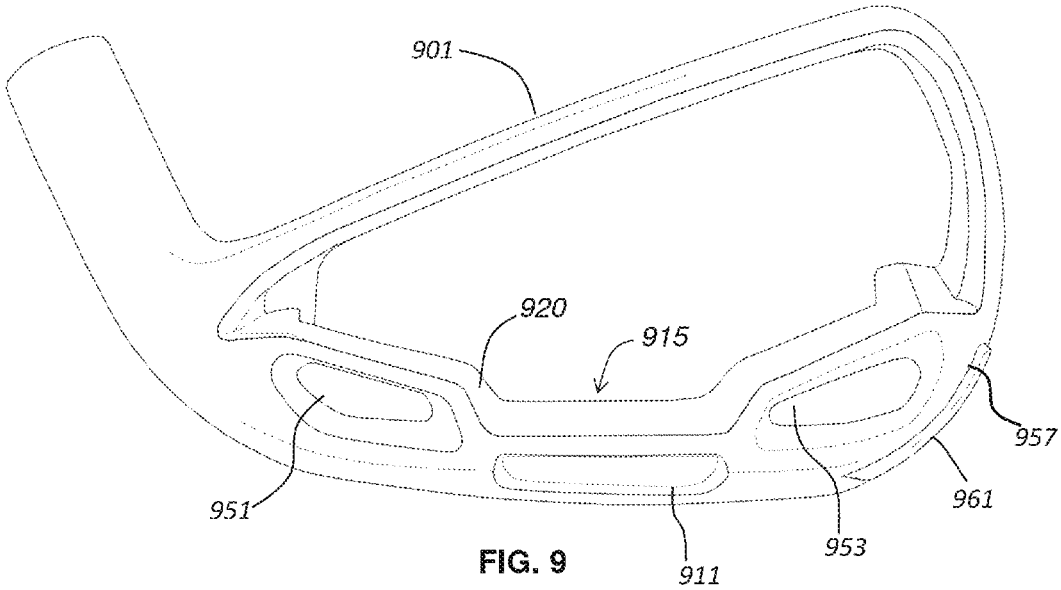
FIG. 9 shows a club head body with recesses that get partially covered by a face insert.

FIG. 9 shows a club head 901 with pockets for inserts that get partially covered by a face insert and that have ports to the back of the club head body. A pocket on the heel side has port 951 allowing an insert to be viewed from outside of the club head, while the pocket on the toe side has port 953. Club head 901 is a cavity-back style club head in which a perimeter body defines a cavity. Further, a back portion 920 of the club head may be spaced away from a back surface of a ball striking face to create an undercut 915.

Further, as shown in FIG. 9, port 953 reveals an insert 961 in pocket 957 and pocket 957 is accessible through a sole-toe opening on the outside of club head 901. This allows insert 961 to provide mass distributed in the most extreme toe and sole directions. As shown in FIG. 9, insert 961 actually protrudes from club head 901 in the toe direction by a small amount (e.g., between about 0.1 mm and about 3 mm). In some embodiments, insert 961 is finished to be flush with an exterior surface of club head 901.

Figure 10:
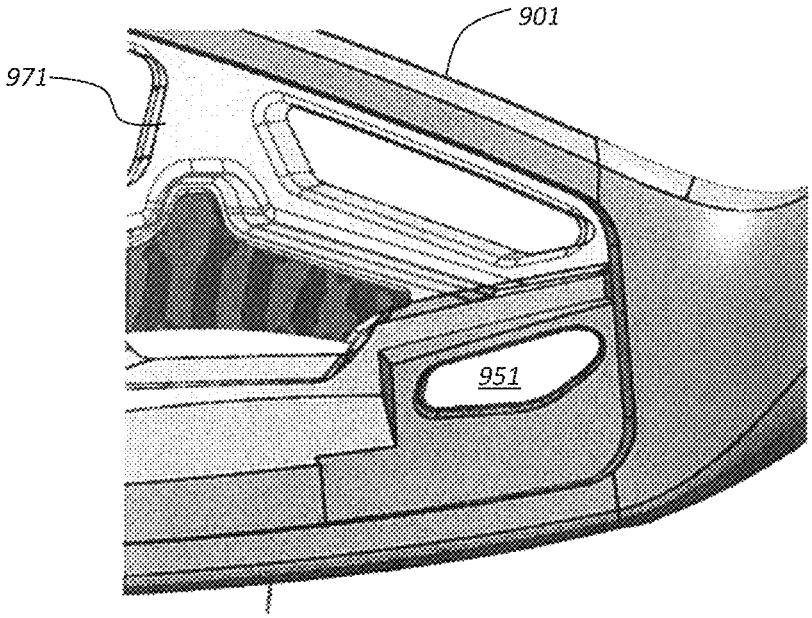
FIG. 10-12 shows a detail view of the club head shown in FIG. 9, with in insert therein.
Figure 11:
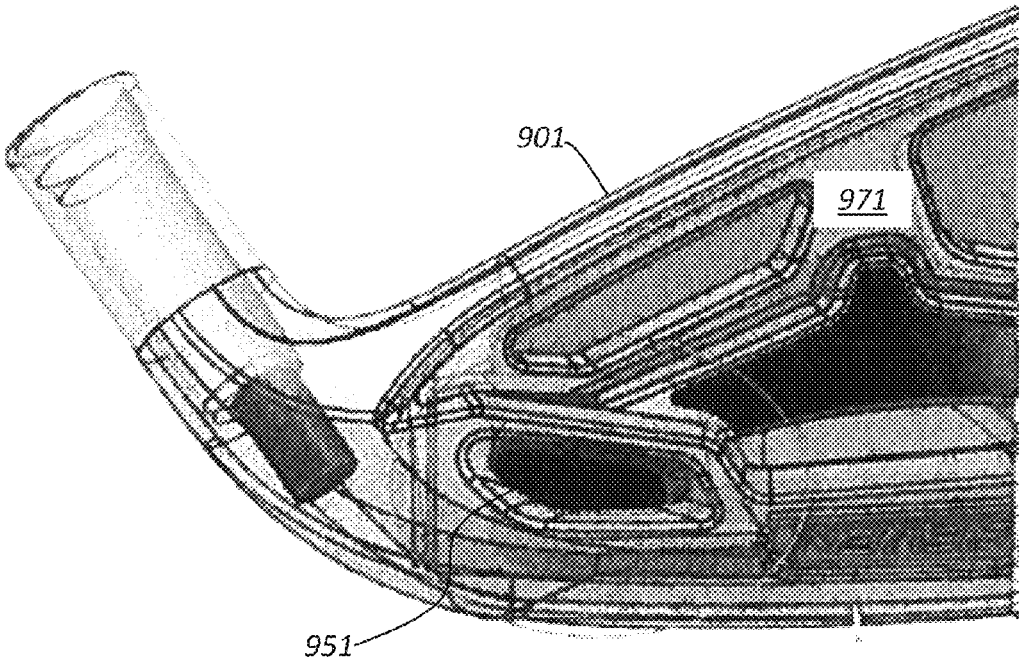
Figure 12:
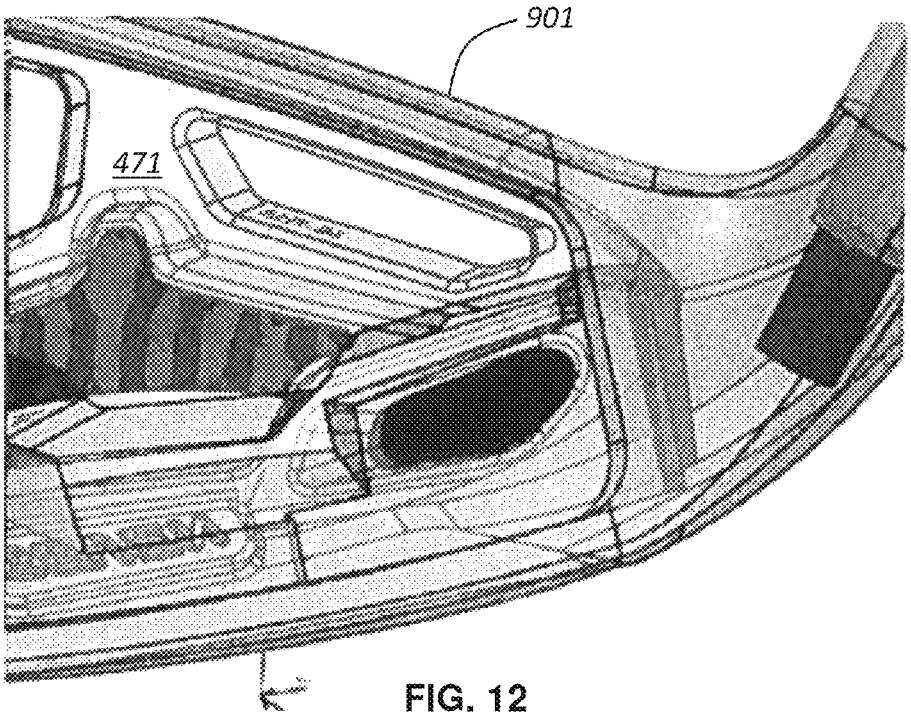

FIG. 10-12 shows a detail view of the club head shown in FIG. 9, with a TPU insert 971 therein. TPU insert 971 is shown to aid in visualizing optional components of a finished club head, noting that club head 901 in FIGS. 10-12 is shown without a strike face insert.

Figure 13:
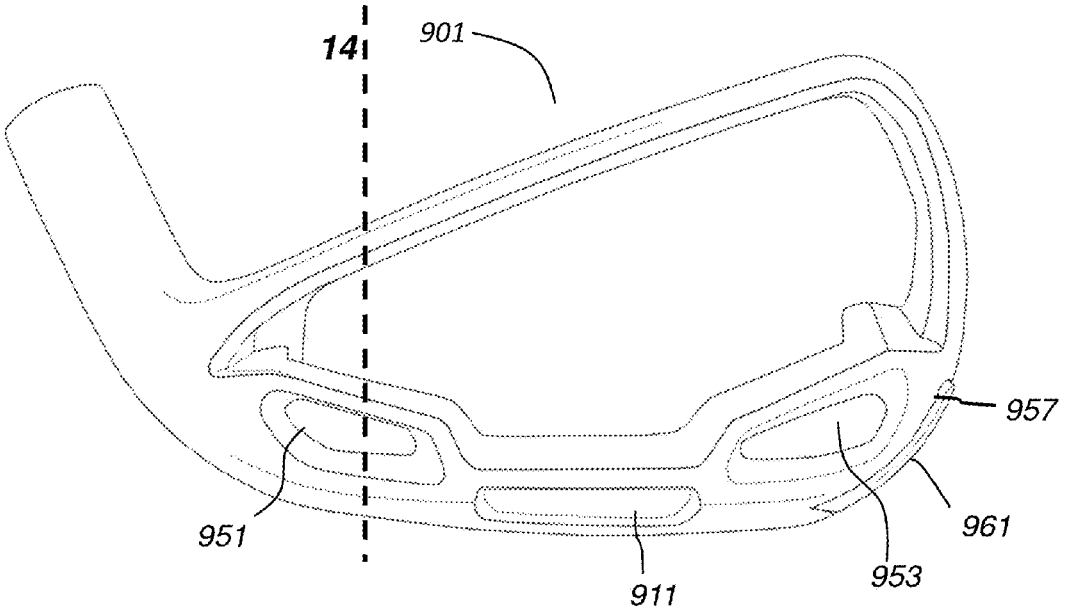
FIG. 13 shows the club head body of FIG. 9, with a line across it.
Figure 14:
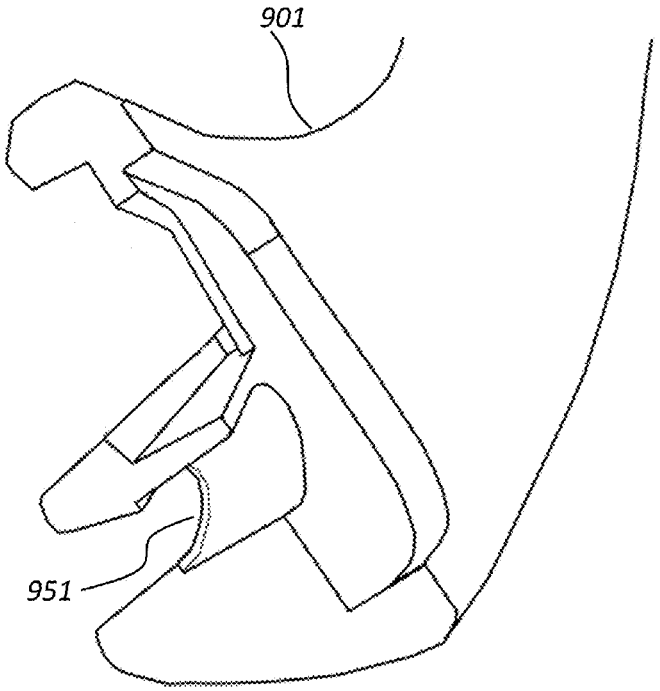
FIG. 14 is a cross sectional view of the club head body shown in FIG. 13.

FIG. 13 shows club head 901 and FIG. 14 is a cross sectional view of club head 901 along the line 14 shown in FIG. 13. FIG. 14 illustrates how a pocket accessible through a face area of the club head can retain a weight insert securely while revealing a portion of the weight insert through port 951. The pocket has a lip on the inside surrounding the port to retain the insert therein.

Revealing a portion of the weight insert solves problems with prior art clubs associated with the need to communicate to a golfer the present effective setting of a tunable club or communicate to a golfer the mass distribution and other playability factors of a club head. Concealing a significant portion of the weight provides significant benefits in terms of manufacturing costs, time, and difficulty, as a weight insert needs only have a small portion of its surface finished for golfer visibility.

Figure 15:
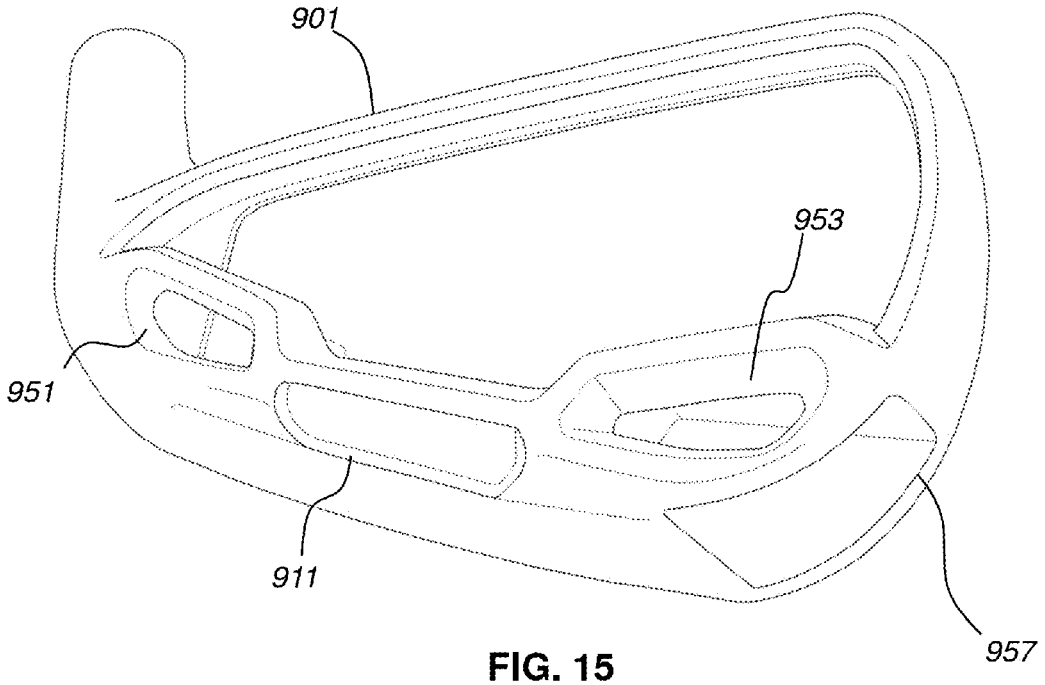
FIG. 15 is a perspective view of the club head body of FIG. 13.

FIG. 15 is a perspective view of the club head 901 showing a recess in the outside surface in the toe area. Recess 957 may include port 953 for revealing a weight insert for sole-toe weighting. Further, a weight insert can be positioned heelward in a recess accessible through the face side, so that the insert is visible through port 951. Note here that club head 901 includes window 911 which can be filled with a continuation of the material of club head 901, (i.e., fake window), filled with some other material (e.g., a TPU insert), or left empty. Window 911 can be manipulated this way to control the mass distribution of the club head. If window 911 is filled with a light-weight material, heel and toe weights can be increased in mass to improve MOI. If a low CG is important, window 411 can be filled with a high mass material. Weighting and mass distribution is discussed in U.S. Pat. No. 8,083,610; U.S. Pat. No. 5,588,923; U.S. Pat. No. 5,776,010; U.S. Pub. 2009/0305815; and U.S. Pub. 2006/0166758, the contents of each of which are hereby incorporated by reference in their entirety for all purposes.

Turning now to the mass distribution control afforded by cell technology, the invention provides innie and outie cells that can reach to extremes of the club head volume to maximize a designer's ability to distribute mass.

Figure 16:
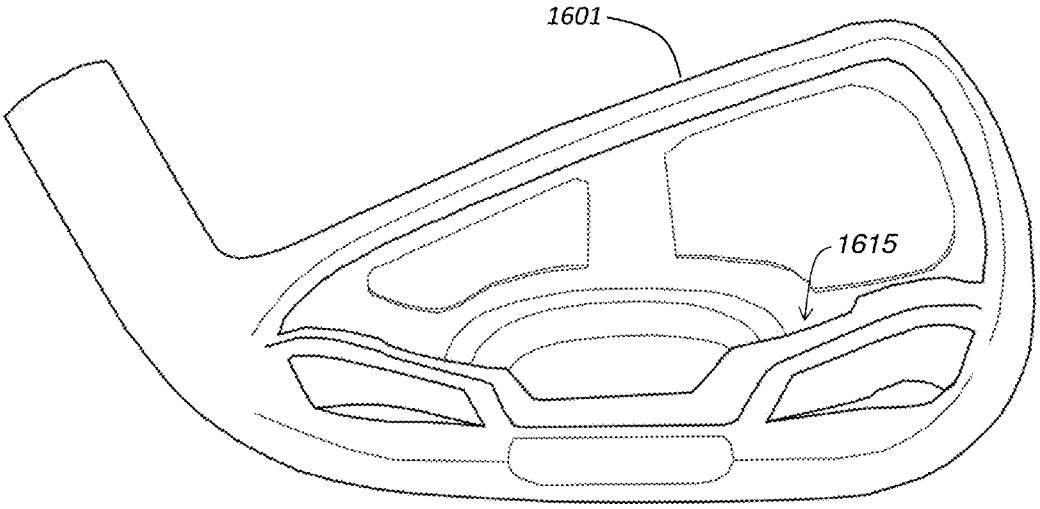
FIG. 16 is a back view of a club head having a innie and outie cells.

FIG. 16 is a back view of a club head 1601 having a innie cells on the back of the body; innie cells on the back of the face, and an outie cell on the back of the face. Club head 1601 is a cavity-back style iron with an undercut 1615.

Figure 17:
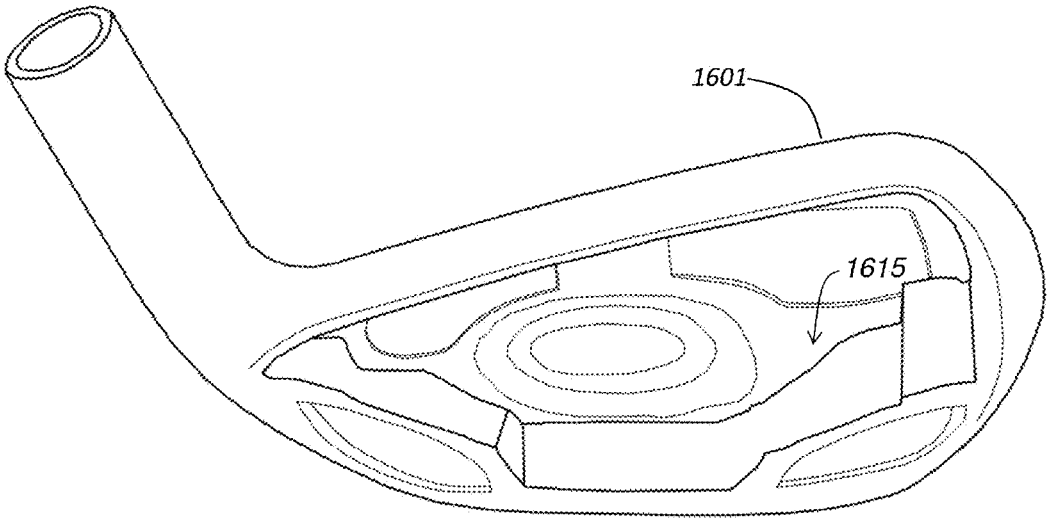
FIG. 17 is a perspective back view of the club head of FIG. 17.

FIG. 17 is a perspective view of club head 1601. By considering FIGS. 16 and 17 together, it will be appreciated that a cell can be deeply undercut with respect to a rear-most member of a club head body. Here, an outie cell on the back of the striking face of club head 1601 is shown descending significantly behind an undercut in the back of the club head body member. Undercutting allows a club head designer to control face strength and mass properties, allow a club head to accommodate an insert (e.g., a TPU insert that can provide information or make the club easy to recognize in a crowded golf bag), allows a window to provide visibility towards the back of a strike face, and provides more opportunities for a designer to place more mass near a heel or toe.

In certain aspects and embodiments, the invention provides recesses that play cell roles and pocket rolls for decreasing mass, accommodating inserts to increase mass, or both. Pocket cells can be designed to conceal an insert or themselves be concealed within a finished club head or to be fully or partially accessible or visible.

Figure 18:
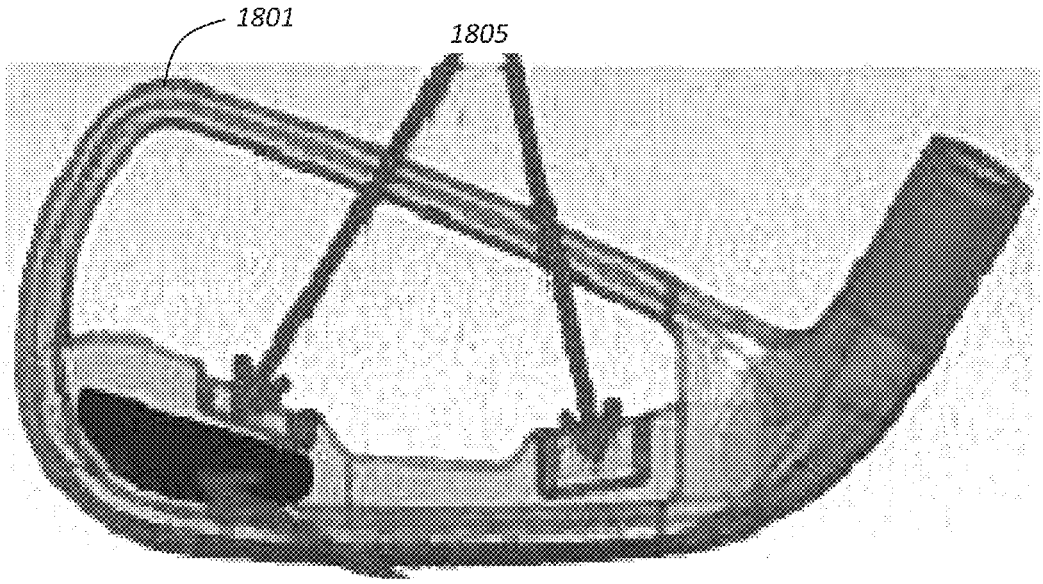
FIG. 18 shows inside cells in a club head body.

FIG. 18 shows a club head 1801 with interior cells 1805. Interior cells 1805 provide similar functionality to those discussed with reference to FIG. 6, but may be partially visible in an assembled club head. In certain embodiments, after a face insert (not pictured in FIG. 18, but see, for example, FIG. 4) is mounted in club head 1801, a golfer may see or access interior cells 1805. The golfer may then fine tune their mass distribution using a set of inserts.

In certain aspects and embodiments, the invention provides a club head body 1901 with optimized mass distribution through the inclusion of cells, both innie and outie, on a surface of the material of club head body 1901.

FIGS. 19A-19E shows a club head body with cells of varying depth. Heel cell 1903, for example, may be a deep innie. Mid-heel cell 1907 may be a shallow innie. Mid-toe cell 1909 may be a shallow outie. Toe cell 1913 may be a deep outie. This progressive depth relationship is illustrative and could be reversed (e.g., to correct a hook versus a slice).

Figure 19A:
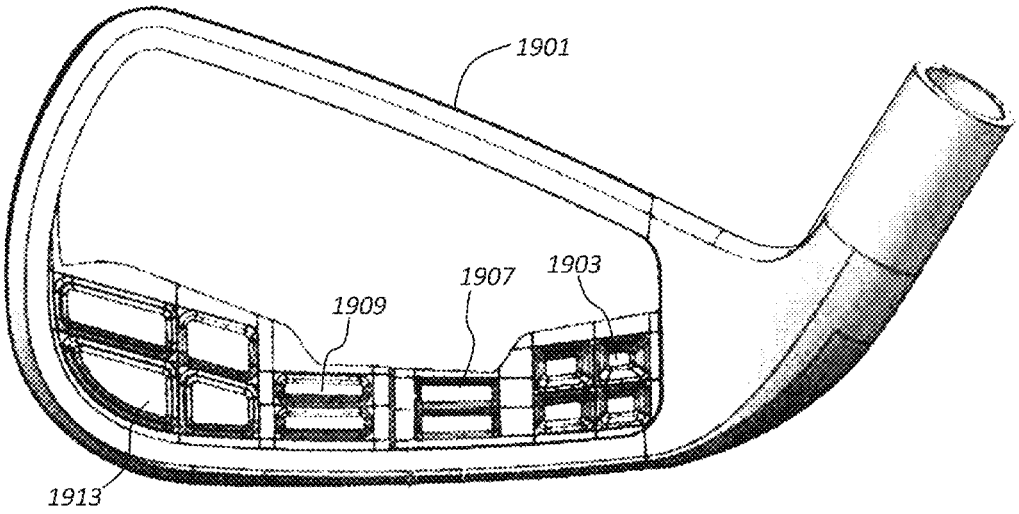
FIGS. 19A-19E shows a club head body with cells of varying depth.
Figure 19B:
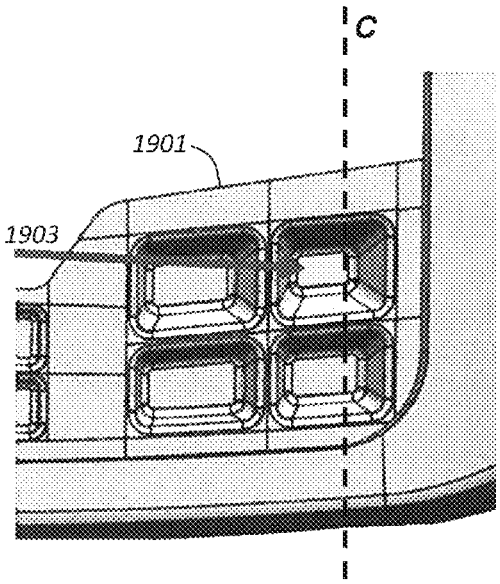
Figure 19C:
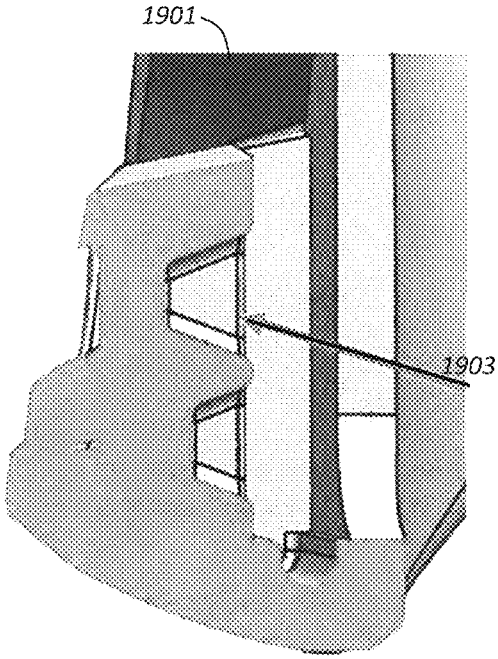

FIG. 19B is a detail view of the club head shown in FIG. 19A and FIG. 19C is a cross sectional view of the club head shown in FIG. 19B along line C. As can be seen in FIG. 19C, heel cell 1903 is a deep innie. Because a club head 1901 can include cells of varying depth, a club designer can fine tune mass distribution. Additionally, a set of clubs can have cell patterns that appear consistent across the set but that use variable depth to tune the mass distribution of each club. It is useful for a set of clubs to have a consistent appearance throughout the set so that the set may be so identified out on the golf course, and prevent two golfers from accidentally co-mingling their clubs and going home with one another's clubs.

Figure 19D:
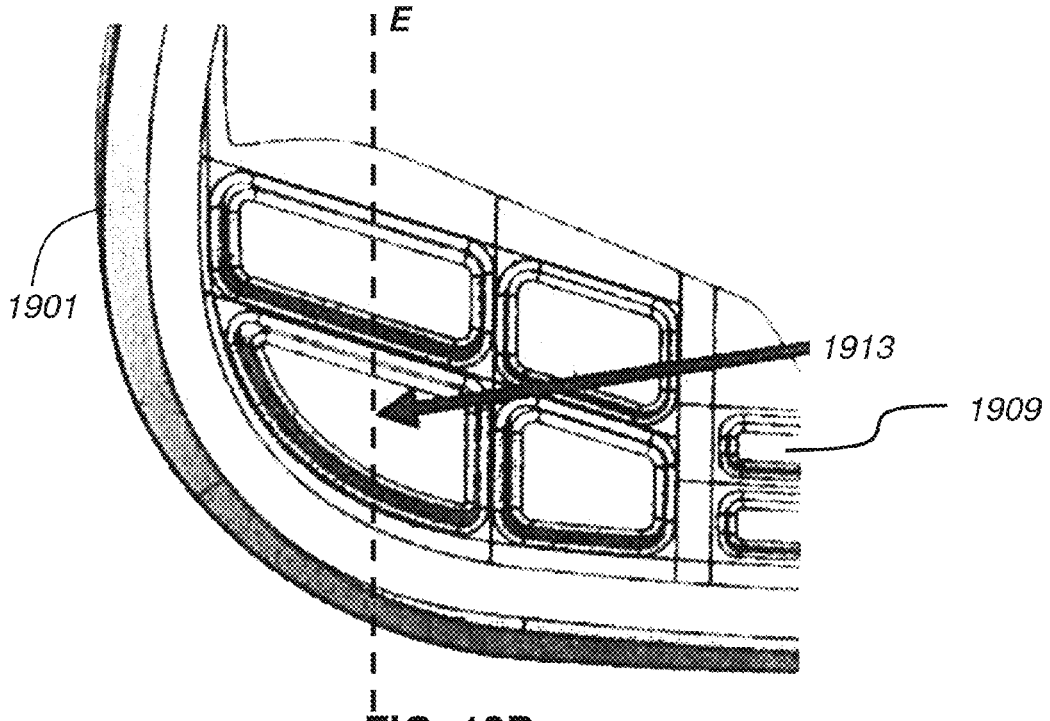

FIG. 19D is a detail view of the club head shown in FIG. 19A.

Figure 19E:
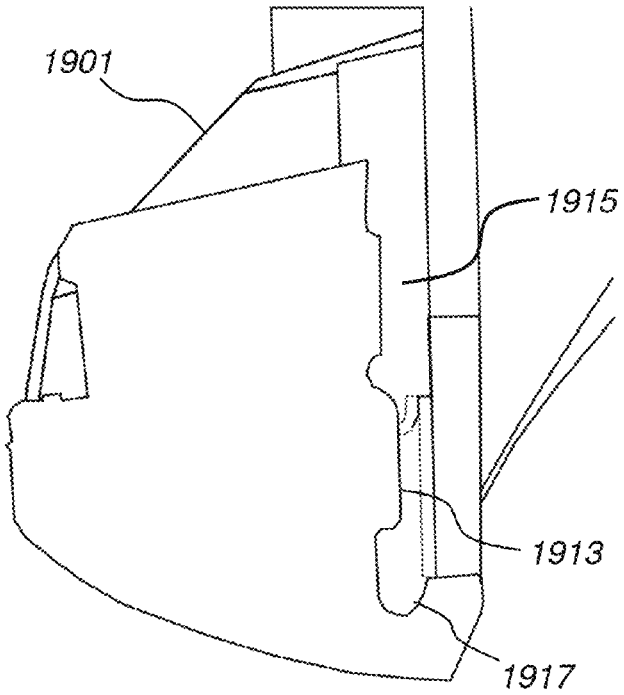

FIG. 19E is a cross-sectional view of club head 1901 shown in FIG. 19D along line E. Club head 1901 also includes an undercut 1915 with a channel 1917 at the base. Use of an undercut 1915 can increase a coefficient of restitution of the face and thus increase ball speed. As can be seen in FIG. 19E, toe cell 1913 is a deep outie. This arrangement may be provided to toe-weight a club head, for example, to correct for a hook or a slice. Other arrangements are possible. For example, the pattern can be substantially reversed to provide a heel-weighted club head. Or a vertical gradient can be provided to provide a sole-weighted club head. Mass related structures are discussed in U.S. Pat. No. 6,932,716; U.S. Pat. No. 6,592,468; U.S. Pat. No. 5,401,021; U.S. Pub. 2011/0275453; U.S. Pub. 2007/0178988; U.S. Pub. 2005/0272528;

and U.S. Pub. 2003/0228932, the contents of which are hereby incorporated by reference in their entirety for all purposes.

In certain aspects and embodiments, the invention provides an iron-type club head with a channelized cell in a floor of a cavity that provides high-speed shots and unexpectedly good coefficient of restitution.

Figure 20:
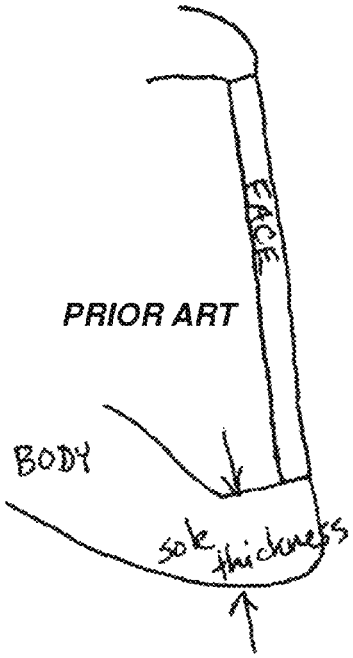
FIG. 20 shows a prior art club head.

FIG. 20 shows a prior art club head. In prior art club heads, it was known that where the sole meets the face is a frequent point of failure in certain constructions.

Figure 21A:
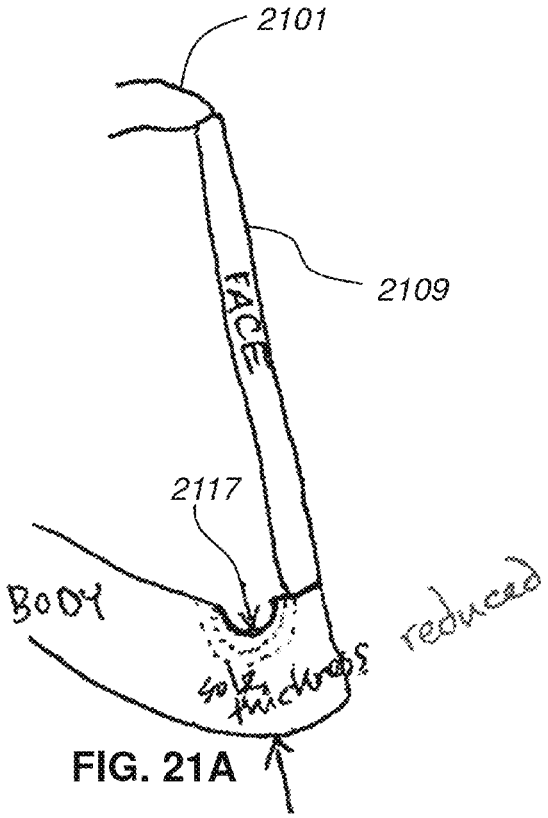
FIGS. 21A and 21B shows a club head channel.
Figure 21B:
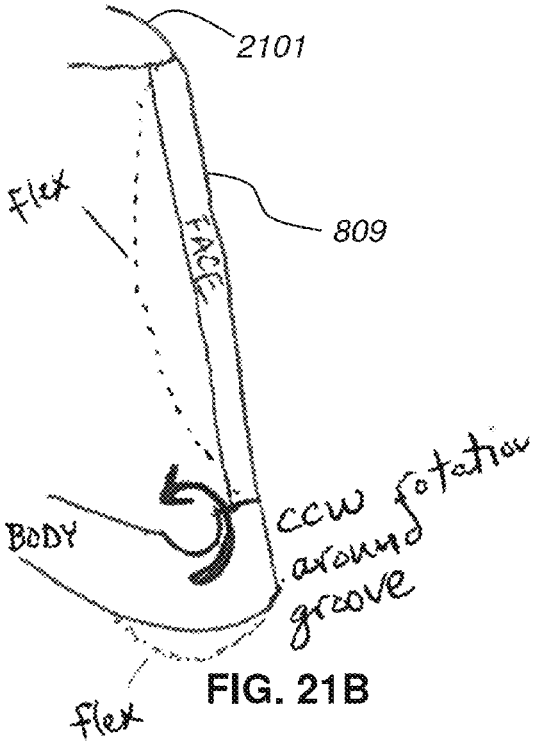

FIGS. 21A and 21B show a club head 2101 with a channel 2117 according to embodiments of the invention. The present invention includes the insight that a channel 2117 in the area where face 2109 meets the sole may allow for material flex that inhibits failure and breakage associated with prior art club heads and also that channel 2117 can greatly increase a distance of a shot made with club 2101.

When an exemplary club head is made and played, it exhibits unexpectedly good ball speed. Without being bound by any mechanism, it is theorized that the channel increases a coefficient of restitution of the face. Accordingly, in some aspects, the invention provides a club head with novel geometry comprising a cutaway, groove, recess, or channel directly behind the face that allows the body of the iron to flex with the face.

In some embodiments, the geometry of the invention thins the body of the iron in the proximity of the face and changes the way the iron behave on impact. The geometry distributes the stress from the face into the iron body, reducing the stress levels experience by the face, allowing for thinner and more resilient face designs. Additionally, the geometry increases iron performance by increasing the club's COR, which in turn increases ball speed and shot distance.

FIG. 21B shows a mechanism of action according to certain embodiments.

An abrupt transition of thickness from the iron face to the iron body puts the burden of impact mainly on the face material itself. The result is a face that flexes, with high levels of localized stress. The body of the iron mainly supports the face and does little to mitigate the stress or add to the flexion performance.

In the new proposed geometry, the thickness of the iron body directly behind the iron face is reduced with a non-flat (e.g., curved or circular) groove 2117. This reduces sole thickness in this region. With the new geometry, upon impact with a golf ball, the face and the body flex. The iron face flexes inward, and the iron body rotates counter clockwise (CCW) as shown in FIG. 21B around the groove. In some embodiments, the groove acts as a hinge for the front half of the iron body to rotate around. This second rotation or flexion reduces the level of the stress experienced by the face alone.

In tests with a 21 degree iron, peak face stress levels in finite element analysis (FEA) simulations dropped from 1191 MPa (abrupt iron to body transition) to 1069 MPa with the new proposed geometry. This reduction in stress improves the durability of iron designs or allows for thinner, higher performing face designs to be used while maintaining current durability levels.

Another added benefit of the new geometry is an increase in the coefficient of restitution of the club head. By adding sole flexion, the overall rigidity of the club head is reduced. The result is more club head flex under load and greater COR values. In initial FEA simulations, the COR of an iron went from 0.79 (abrupt iron to body transition) to 0.804 with the new proposed geometry.

In certain aspects and embodiments, the invention provides inserts and insert sets for golf club heads, as well as golf club heads that include inserts for customization of mass distribution. In some embodiments, inserts are interchangeable (e.g., by a user). Additionally, inserts and their corresponding receiving cells can have easy-to-manufacture and easy-to-use geometric shapes, while also having a shape that concentrates insert mass in a location that optimizes effect on MOI.

Figure 22A:
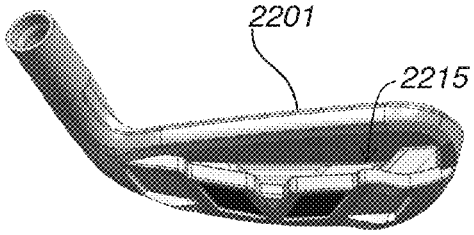
FIGS. 22A-22D show a club head with skewed cells for inserts.

FIG. 22A depicts a club head 2201 with recessed cells and corresponding inserts that exploit a shape substantially like a parallelepiped to provide customizable mass distribution that is easy to interchange and that can increase MOI more effectively that inserts of other shapes such as cylinders or weight screws.

Figure 22B:
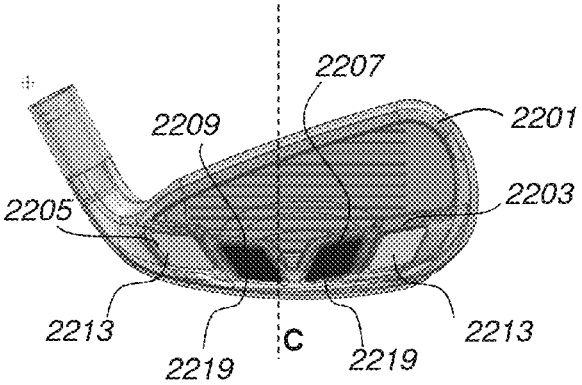

FIG. 22B shows club head 2201 from behind. Club head 2201 includes an outer toe recess 2203, an outer heel recess 2205, an inner toe recess 2207, and an inner heel recess 2209. Disposed within each of outer toe recess 2203 and outer heel recess 2205 is an outer insert 2213. Disposed within each of inner toe recess 2207 and inner heel recess 2209 is an inner insert 2219. As can be appreciated by looking into undercut 2215 in FIG. 22A, the recesses and the inserts have a skewed shape, i.e., sheared or slanted. A horizontal section through each insert when the club is at address may approximate a parallelogram. Each insert may approximate a parallelepiped. The facets of each insert may each define a skewed geometry. Alternatively, the recesses and the inserts could have a bent or a curved shape.

Figure 22C:
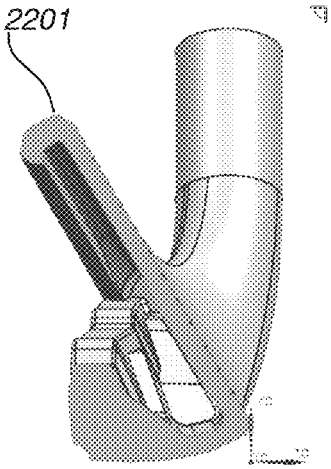

FIG. 22C is a cutaway view of club head 2201 through line C of FIG. 22B. Here it can be seen that the recess and inserts may be accessible from a back of club head 2201.

Each of insert 2213 and 2219 may be shaped with a skew or a bend such that a substantial portion of the mass of that insert is located far away from a z axis (an axis that is vertical when the club head is at address). Additionally, the skewed shape allows the insert port, i.e., the aperture into each of recess 2203, 2205, 2207, and 2209, to be conveniently located along the back portion of the perimeter body, facing out and back and thus easily accessible for a golfer. Each insert may be easily inserted into, and removed from, club head 2201. Additionally, due to the oblique shape of the insert, a substantial amount of its mass is located away from an axis of rotation that is vertical when the club head is at address (i.e., a z axis). Significantly, due to the oblique, or "sheared" shape (in some embodiments) or to the curved or bent shape (in some embodiments), an insert of the invention has a greater proportion of its mass located away from the z axis than an insert of another shape. By moving more of the mass away from the z axis, MOI of the club head is increased.

Moment of inertia (MOI) relates to the inertia of a rotating body and is analogous to mass in linear motion. A MOI exists with respect to an axis of rotation. In a golf club head, more than one axis of rotation may have significance for the playing properties of the club head. For example, with reference to a club head that is at address, a MOI that is horizontal and extends through the heel and toe will affect how much the club head tends to "roll" (like a wheel) head-over-sole. For making off-center hits fly straight, the MOI about an axis that is vertical (a z axis) when the club head is at address is significant (e.g., $I_{ZZ}$ is MOI about a z axis). For a continuous mass distribution (e.g., for a body that is not a regular geometric object), the MOI about the z axis is given by Equation 1.

$$I_{ZZ} = \int_0^M r^2 \, dm \qquad \text{Equation 1}$$

where mass M is divided into infinitesimally small units dm, each unit dm being a distance r from axis z. An effectively similar measure can be calculated by modeling a club head as a number i of discrete mass elements and calculating $I_{ZZ}$ as shown in Equation 2.

$$I_{ZZ} = \sum_i m_i r_i^2 \qquad \text{Equation 2}$$

where $m_i$ is the mass of the ith mass element and $r_i$ is the distance of the center of mass of that mass element from the axis z. It can be noted from Equations 1 and 2 that MOI scales with the square of the distance from the axis of rotation. Thus there is particular benefit of locating mass away from the axis. Particularly where a fixed amount of mass is to be used overall in a club head, high MOI is to be had by pushing that mass into a location with a highest value for r. Given that a mass must occupy some volume, an insight of the invention is that optimizing MOI can involve pushing the mass to be concentrated within a cylindrical shell defined by an outer radius $r_o$ and an inner radius $r_i$.

Figure 22D:
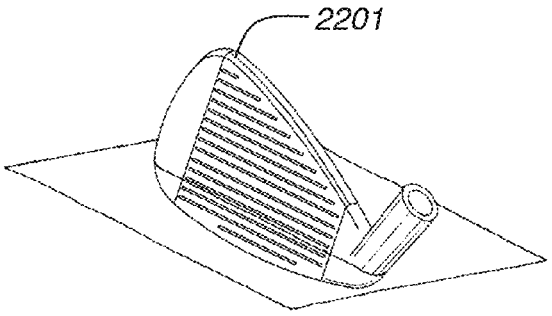

FIG. 22D gives a perspective view of club head 2201 having an idealized plane drawn intersecting the club head.

Figure 22E:
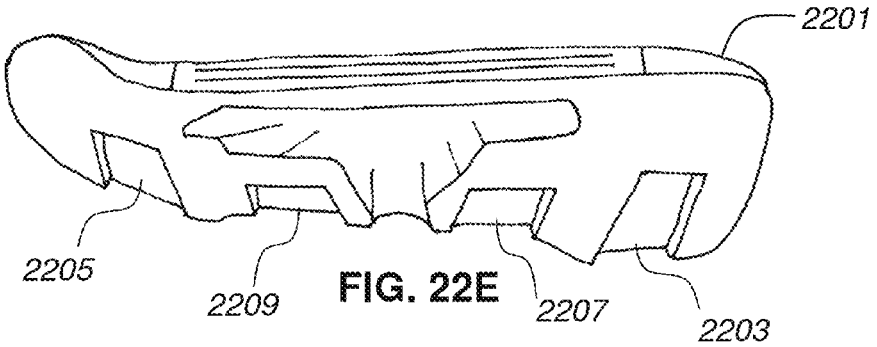
FIG. 22E shows a cutaway view through a club head along the plane drawn in FIG. 22D.

FIG. 22E shows a cutaway view through club head 2201 along the plane drawn in FIG. 22D. The cutaway view reveals the pocket-like space provided by each of outer toe recess 2203, an outer heel recess 2205, an inner toe recess 2207, and an inner heel recess 2209. As depicted in this embodiment, outer toe recess 2203 and outer heel recess 2205 have a first geometry that is substantially similar to one another. Inner toe recess 2207 and an inner heel recess 2209 have a second geometry that is distinct from the first. However, in certain embodiments, any or all of the recesses have the same geometry.

Figure 22F:
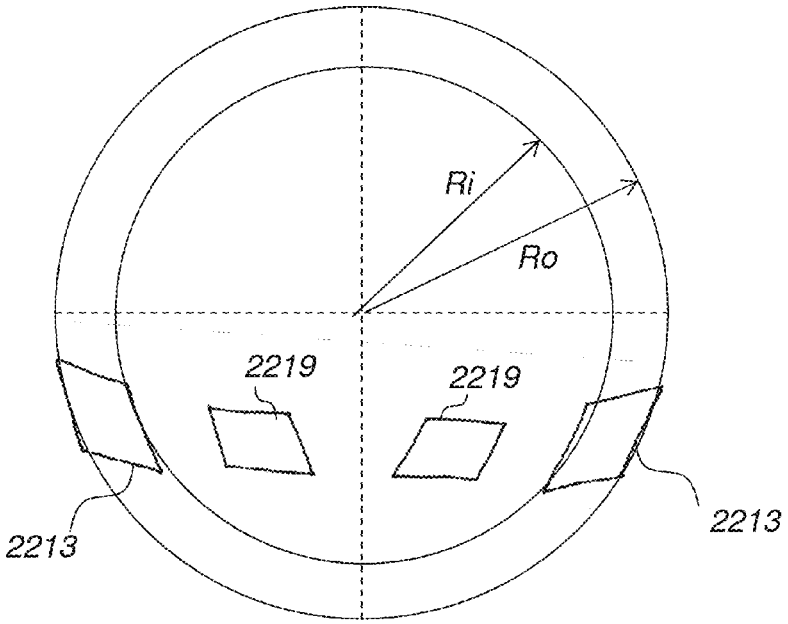
FIG. 22F shows outer inserts and inner inserts that could be provided to be inserted into the recess shown in FIG. 22E.

FIG. 22F shows outer inserts 2213 and inner inserts 2219 that could be provided to be inserted into the recess shown in FIG. 22E. The inserts in FIG. 22F are depicted in the same orientation as the corresponding cells in FIG. 22E. FIG. 22F also includes dotted lines that represent x and y axes that cross at an intersection with a z axis, wherein the x, y, and z axes are orthogonal. Also depicted are an outer radius ro and an inner radius ri, as well as rings that illustrate the outer and inner walls of a cylindrical shell centered on the z axis. Looking particularly at outer inserts 2213, it can be seen that substantially all of their mass lies beyond the reach of ri. A different weight insert of the same mass and density but having a shape known in the prior art (e.g., weight screw, cube, cylinder, bulk mass), if located so that a center of gravity of the weight insert were in the same place as a center of gravity of outer insert 2213 would have a substantial amount of mass within the reach of ri.

Thus as can be seen from FIGS. 22A-22F, the invention provides a golf club head with one or more recesses and inserts that have a corresponding shape. The shape of the recess and insert is such that an inner surface substantially follows a cylinder defined by an inner radius ri extending from a rotational axis that is vertical when the club head is at address (the inner surface may be a plane intersecting the cylinder in two places or it may be curved along the cylinder). Preferably, the recess and the insert each have an outer surface that substantially follows a cylinder defined by an outer radius ro extending from a rotational axis that is vertical when the club head is at address. Substantially follows can mean that a first element is designed and made to be a as close as possible to a second element given their respective geometries and manufacturing tolerances.

Use of the interchangeable inserts 2213 and 2219 allow for a number of customization options. For example, a customer can be given a set of inserts, having a variety of masses or densities, for customizing their golf club.

In certain embodiments, an insert can fit into more than one of the different recesses, even where those recesses appear at first to be mirror images of one another and thus chiral.

Figure 23:
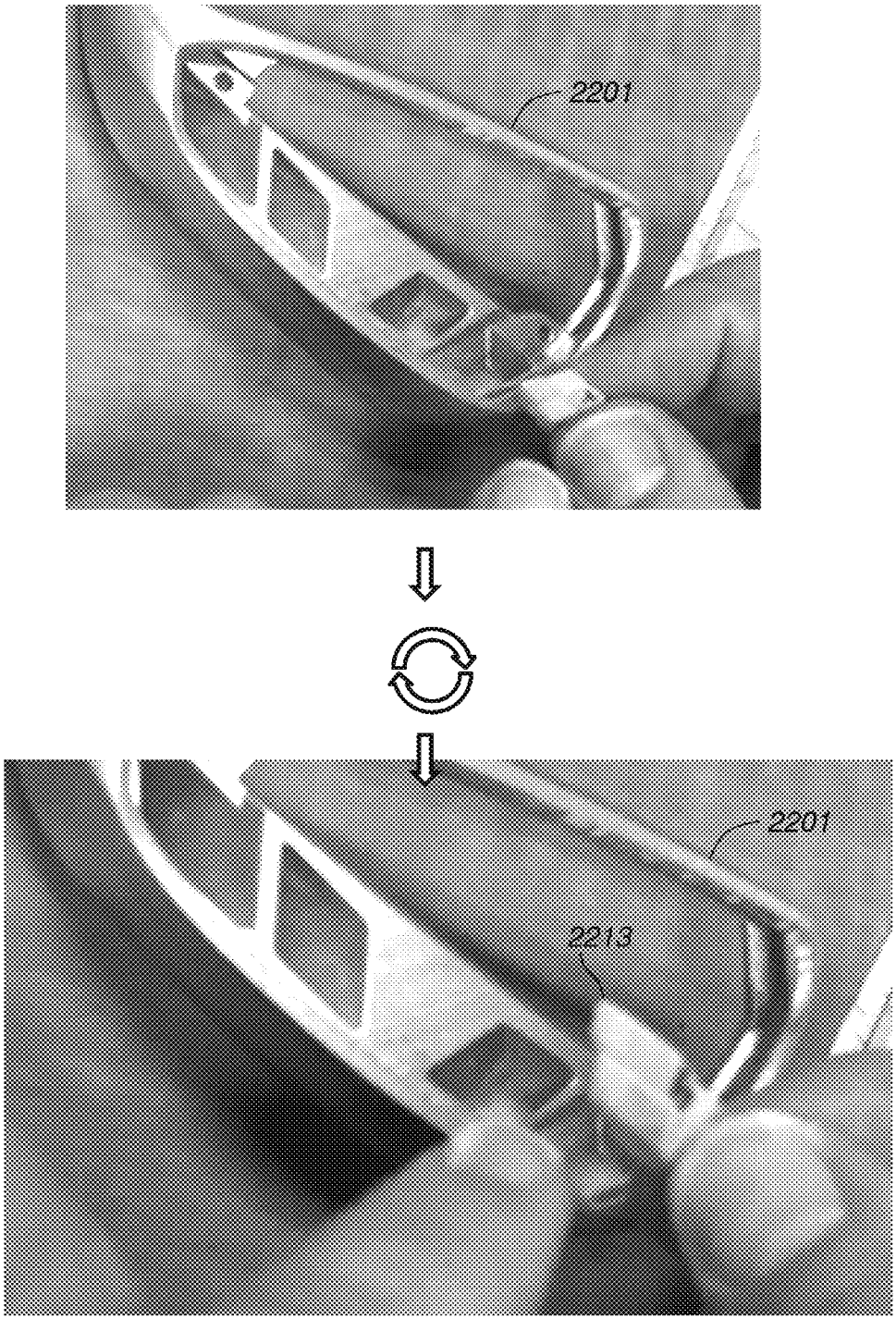
FIG. 23 shows moving an insert from toe to heel.

FIG. 23 shows moving an insert 2213 from toe to heel. Here, the recesses are skewed in different direction as seen from the back of the club. This allows for the inserts to contribute well to increasing MOI. A customer can use a single insert 2213 to preferentially heel-weight or toe-weight club head 2201. As shown in FIG. 23, insert 2213 is marked with a capital letter T on one side and a capital letter H on the other. The customer thus knows to insert it into the heel recess with the H visible or into the toe recess with the T visible.

Club heads according to the invention can come with a variety of inserts performing a variety of functions and can include recess that are not filled by an insert. For example, a club head could include four recesses and two inserts that, taken together, sum to a desired mass. The customer (or a golf pro performing a custom fitting) could position the two inserts to bias the mass of the club in a desired fashion (e.g., heel-weighted, toe-weighted, max MOI, low CG, etc.).

Figure 24:
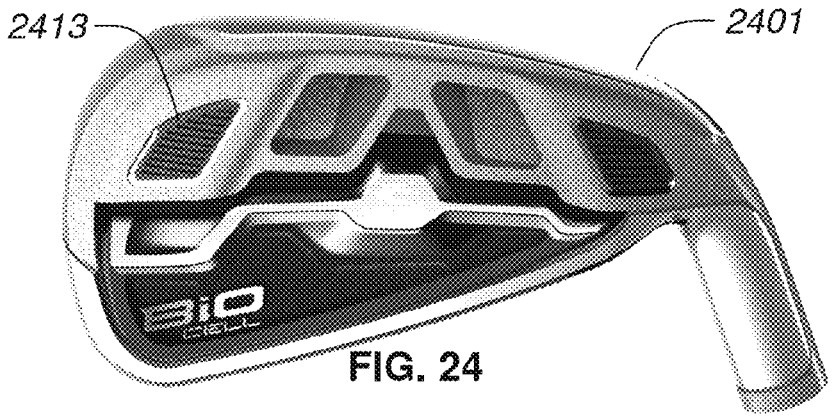
FIGS. 24-26 show variant weight insertion.

FIG. 24 depicts an embodiment in which club head 2401 includes two outer inserts 2413 to maximize MOI.

Figure 25:
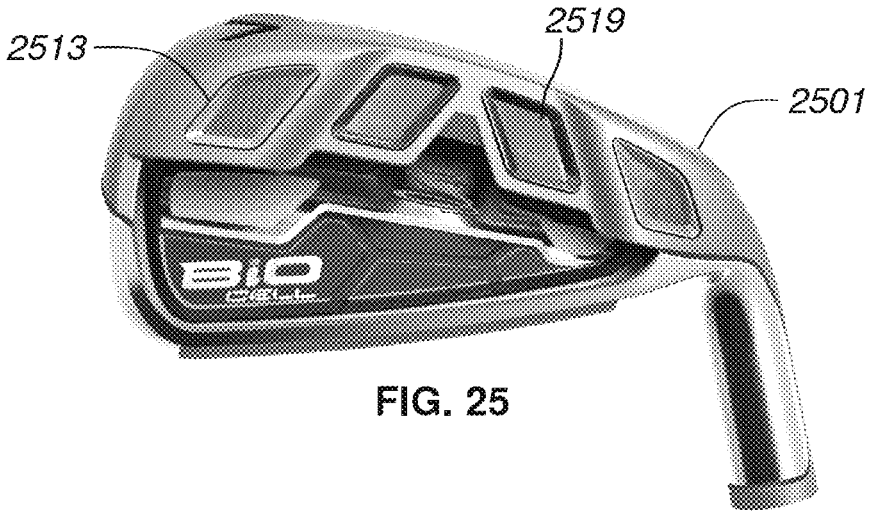

FIG. 25 shows a club head 2501 with two outer inserts 2513 and two inner inserts 2519 that allow the mass to be fine-tuned to a wide variety of settings, particularly where club head 2501 is provided with a rich set of inserts representing a variety of masses.

Figure 26:
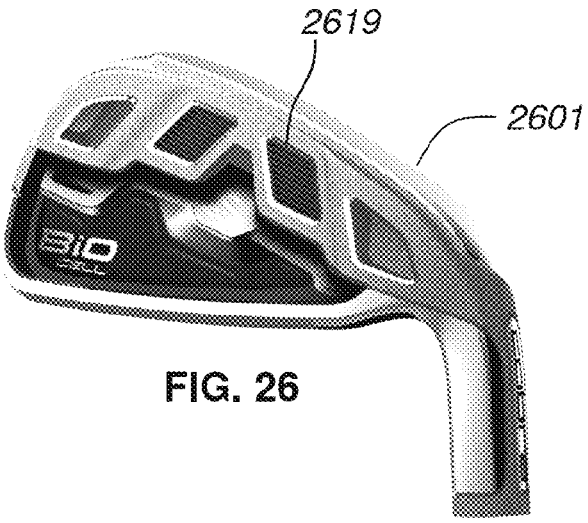

FIG. 26 shows a club head 2601 with two inner inserts 2619 and two outer recess that are empty. It will be understood that when club head 2601 is at address, the inner recess are lower on the club head than the outer recesses. Thus it may be found that the depicted arrangement provides a very desirable location of a club head center of gravity (i.e., low when the club head is at address).

Inserts may be retained in a club head by any suitable mechanism. Exemplary mechanisms that may be preferred include press-fit, adhesives, a mechanical fastener, a cover plate, or a detent mechanism. For example, inserts shown in FIG. 22B may be held in place by press-fit.

Figure 27:
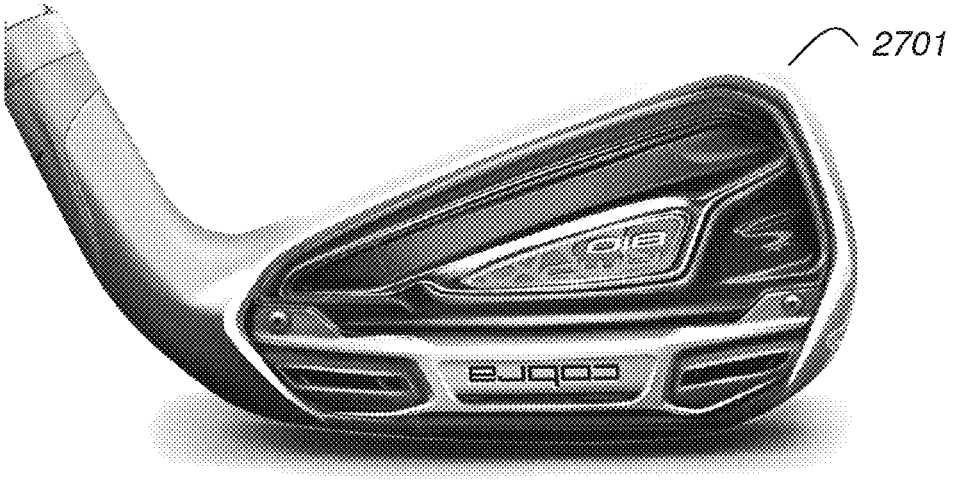
FIGS. 27 and 28 show a club head with weight cover plate.

FIG. 27 shows a club head 2701 with a weight cover plate. This allows a club provider (e.g., a pro shop or the manufacturer) to insert a particular set of inserts and then to "close up" the club head 2701 before sending it to a golfer. The cover plate can be held on to the club head by any suitable mechanism such as adhesives, screws, or rivets.

Figure 28:
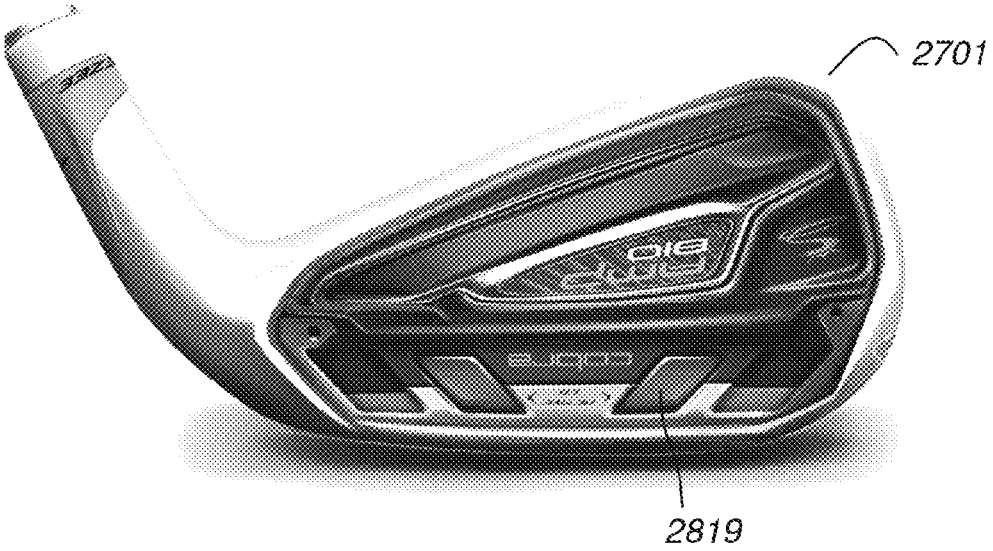

FIG. 28 shows club head 2701 with the cover plate removed, revealing two of inner insert 2819 positioned in recesses therein.

One benefit that arises from the use of recessed cells and inserts as described herein is that a single club head can be given different mass properties based on the particular inserts that are used and the masses and densities of those inserts (or lack thereof). A further benefit arising out of that benefit is that a baseline set of club heads can be used to provide multiple different sets of golf clubs. Further, since the mass distribution within each club head can be customized, the mass distribution across a set of clubs can be customized. For some golfers, what is needed out of their long irons is different than what is needed out of their short irons. Moreover, that difference may vary progressively across the clubs in a set.

Accordingly, a set may be most beneficial to a golfer if a mass distribution property varies progressively from club to club in series in a set. Sets of clubs are described in SYSTEM AND METHOD FOR MULTI-SET COLLECTION OF GOLF CLUBS, U.S. Provisional Patent Application No. 61/764,300, filed Feb. 13, 2013, the contents of which are incorporated by reference. Further, use of inserts as described herein can provide a mass distribution that varies progressively through a set, and one golfer may have that varying mass distribution vary across their clubs differently than another golfer.

FIG. 29 illustrates three sets of golf clubs in which mass distribution varies according to a pattern that is similar in each set, but varies across the particular clubs differently within each set. In FIG. 29, panels A-F each show one distribution of inserts. Table 1 lists three sets of clubs according to how the clubs within each set may be configured with the mass distribution patterns illustrated by panels A-F of FIG. 29.

TABLE 1

Mass configurations as shown in Panels A-F of FIG. 29 in each club within each of Set 1, Set 2, and Set 3

| Figure panel | Set 1 | Set 2 | Set 3 |
|---|---|---|---|
| A | 4i | 4i, 5i | 4i |
| B | 5i | 6i | 5i |
| C | 6i, 7i, 8i | 7i, 8i | 6i, 7i |
| D | 9i | 9i | 8i, 9i |
| E | PW | PW, GW | PW |
| F | GW, SW, LW | SW, LW | GW, SW |

As illustrated by Table 1, a set of inserts of the invention can be applied to a set of clubs in different ways to make different sets with different properties.

Inserts of the invention can each be made to have any desired density and can be made with a variety of materials and can include any of a number of additional features. For example, inserts may be tungsten, or may include tungsten along with other materials, such as a tungsten slug embedded within a polymer housing, or a tungsten powder distributed within a matrix material such as a polymer (e.g., TPU, PTFE) or rubber. Inserts can be lightweight, such as a polymer or a rubber material and can even include void space, such as by being porous or including an open void therein. Inserts can include a viscoelastic material for vibration dampening. Moreover, inserts can include materials that are renewable or recycled, thus reducing the environmental footprint of a golf club. For example, inserts may be made from wood (e.g., salvaged wood from old building projects) or a recycled plastic.

Figure 30:
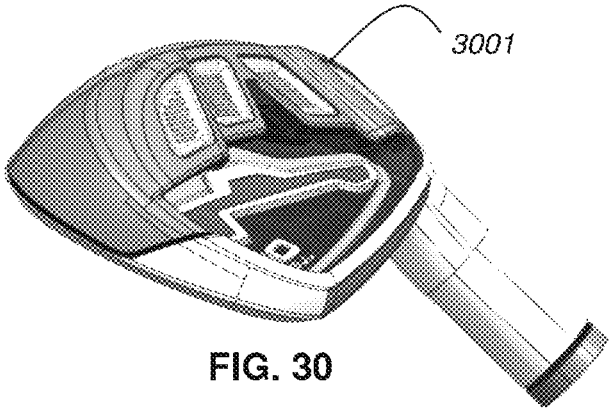
FIG. 30 shows a club head of some embodiments.

FIG. 30 shows a club head 3001 that includes four inserts within recesses therein. Each insert is capped at the exposed surface with a textured cap. This feature can make inserting the inserts easier, by giving a user a better grip on the insert. In the depicted embodiment, the textured cap includes a recessed surface surrounded by a beveled edge with an inward-sloping bevel. Each recessed surface has a set of texture elements such as parallel ridges or grooves.

Figure 31:
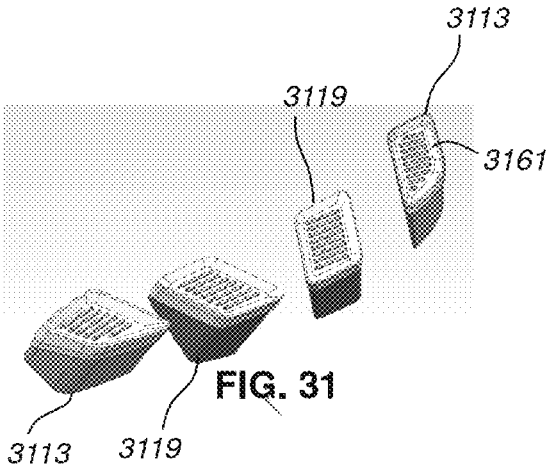
FIG. 31 shows a set of inserts.

FIG. 31 shows the set of inserts for club head 3001. The set includes outer inserts 3113 and inner inserts 3119. Each insert includes a cap member 3161 with the textured surface. Additionally or alternatively, cap member 3113 may be made with a soft or viscoelastic material which may protect club head 3001 from impacts (e.g., while being carried in a golf bag).

Figure 32A:
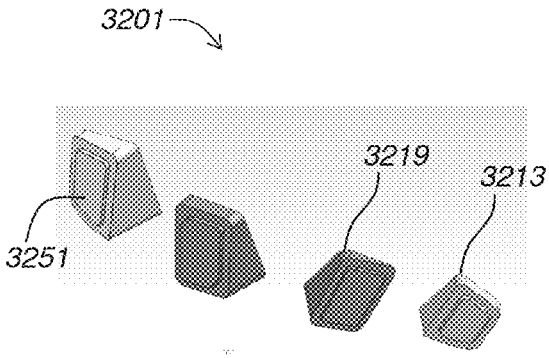
FIGS. 32A and 32B show a mixed set of inserts.
Figure 32B:
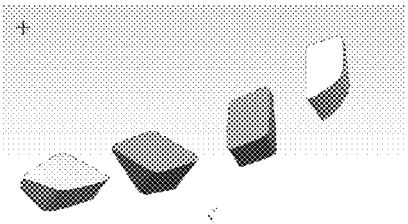

FIGS. 32A and 32B show a mixed set 3201 of inserts including outer inserts 3213 and inner inserts 32119. Each insert has a pad member 3251 on it. Pad member 3251 can be an adhesive pad for fixing the set 3201 into a club head 3001 (e.g., with a peel-off cover surface). Pad member 3251 can include a viscoelastic dampening material, such as a layer of springy material that ends up disposed between each insert and an inner surface of a recess on the club head.

Figure 33:
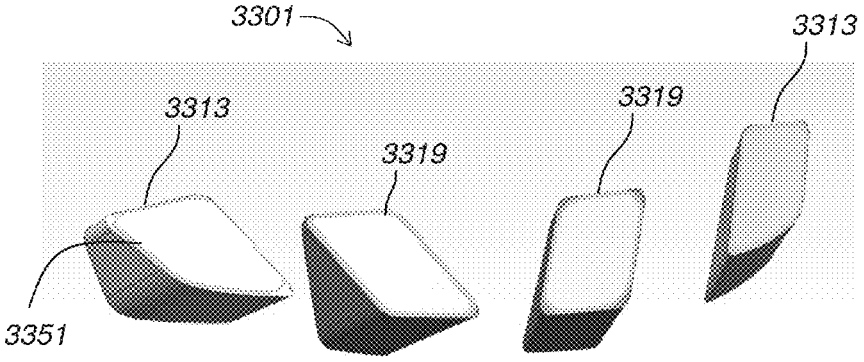
FIG. 33 shows a set of treated inserts.

FIG. 33 shows a set 3301 of treated inserts. Set 3301 includes outer inserts 3313 and inner inserts 3319. Each insert includes a surface treatment 3351 which may be visible from an outside of club head 3001 after the inserts are installed. Surface treatment 3351 can include indicia (e.g., providing information about the inserts and their role in the playability of the golf club). Surface treatment 3351 may include a protective finish (e.g., a baked enamel, a polymer coating, anodizing) to protect the inserts and any indicia thereon.

Figure 34:
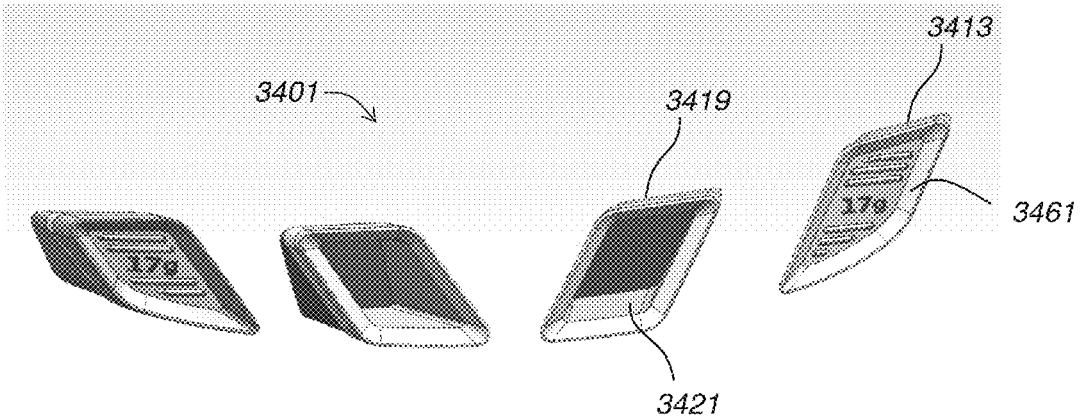
FIG. 34 shows a set of inserts.

FIG. 34 shows a set 3401 of inserts for heightened perimeter weighting. Set 3401 includes outer inserts 3413 and inner inserts 3419. Outer inserts 3413 each include a cap member 3461. In set 3401, each inner insert 3419 includes an insert recess 3421 defining an opening into the insert. The perimeter of the insert recess 3421 may be finished to have an appearance similar to the other inserts in the set (e.g., a beveled edge to match inserts that do not include a recess therein). This provides the useful benefit that it is clear at a glance that any particular golf club head has a full set of inserts inserted therein. Including a recess within an insert allows an insert to add some, but only a very small amount of, mass to a club head. Including a recess within an insert further allows for the insertion of an insert into the insert. Thus, a club head my include a recess having a nested set of inserts therein, in which one or more of the inserts includes a recess with an insert therein.

Figure 35:
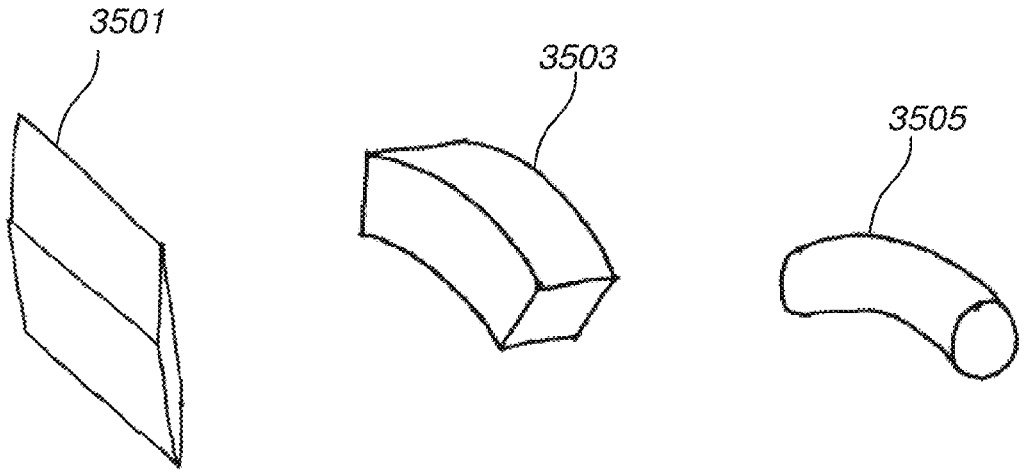
FIG. 35 shows various shapes for inserts.

FIG. 35 shows various shapes for inserts. Insert 3501 has a parallelepiped shape. Insert 3503 exhibits a curved bar shape. Insert 3505 shows a bent rod shape. Each of these shapes can be used with a club head that includes recesses of a complementary shape and each of these shapes will concentrate the mass of the insert in a cylindrical shell that is coaxial with an axis of rotation of the club head that is vertical when the club head is at address.

A club with at least one recess may include an insert. A club with a recess and optionally with an insert may include a channel for increased ball speed. Any one of these features may be provided alone.

For example, the invention provides a golf club head comprising a body with a toe side, a heel side, a sole portion, and a top portion. A hosel extends from the heel side and a ball striking face member is supported by the main bod. This club head includes a channel in a surface of the sole and adjacent to a back surface of the face member. The channel may have a semi-circular cross-section. The channel may run from heel to toe. The channel may be in an upward-facing, inner surface of the sole. In some embodiments, the body defines a cavity in the back of the club head. The club head may include an undercut space extending towards the sole from the cavity.

In certain embodiments, wherein the channel has a maximum cross-sectional dimension between about 0.1 mm and about 4 mm. Optionally, the ball striking face member is a face insert comprising a first material and the body comprises a second material. Such a club head may optionally include one or more recesses into a back side of the body. Such a club head may optionally include one or a a set of inserts of varying densities dimensioned to fit into the recesses.

In another example, the invention provides a golf club head with a body and a face connected to the body, the face having variable thickness provided by one or more recessed cells.

In another example, the invention provides a golf club head having a body with a face insert opening for attachment of a face insert, the body having one or more pockets therein accessible through the face insert opening. The club head has at least one insert member in the one or more pockets.

In a further example, the invention provides a golf club head that has a main body with a toe side, a heel side, a sole portion, and a top portion as well as a hosel extending from the heel side and a ball striking face insert supported by an attachment perimeter defining an aperture through the main body. The club head includes one or more cells defining recesses into the body member and only accessible through the aperture.

As used throughout, any reference to direction that does not otherwise specify is made with reference to a club head at address. As used herein, "or" means "and or or", commonly seen as "and/or", unless otherwise indicated.

While it is apparent that the illustrative embodiments of the invention disclosed herein fulfill the objectives stated above, it is appreciated that numerous modifications and other embodiments may be devised by those skilled in the art. Therefore, it will be understood that the appended claims are intended to cover all such modifications and embodiments, which would come within the spirit and scope of the present invention.

References and citations to other documents, such as patents, patent applications, patent publications, journals, books, papers, web contents, have been made throughout this disclosure. All such documents are hereby incorporated herein by reference in their entirety for all purposes.

The invention claimed is:

1. A golf club head comprising:

a body comprising a top line, a heel portion, a toe portion, and a sole portion;

a hosel extending up from the heel portion;

a ball striking face supported by the body;

a back portion extending between the heel portion and the toe portion and up from the sole portion, wherein at least part of the back portion is spaced away from a back of the ball striking face to define an undercut in communication with a cavity in a back of the club head;

a plurality of recesses into the back portion; and an insert having a parallelepiped shape disposed within at least one of the plurality of recesses, wherein the plurality of recesses comprises at least a pair of recesses, each of the pair of recesses having a shape that is substantially a mirror image of a shape of the other one and the pair of recesses are skewed in different directions as seen from behind the club head.

2. A golf club head comprising:

a body comprising a top line, a heel portion, a toe portion, and a sole portion;

a hosel extending up from the heel portion;

a ball striking face supported by the body;

a back portion extending between the heel portion and the toe portion and up from the sole portion, wherein at least part of the back portion is spaced away from a back of the ball striking face to define an undercut in communication with a cavity in a back of the club head;

a plurality of recesses into the back portion; and an insert having a parallelepiped shape disposed within at least one of the plurality of recesses, wherein the plurality of recesses comprises a recess into the heel portion and a recess into the toe portion;

wherein the recess into the heel portion and the recess into the toe portion exhibit a chiral relationship to one another; and wherein the insert is dimensioned to be inserted into the recess into the heel portion and if removed must be rotated to be inserted into the recess into the toe portion.

3. An iron-type golf club head comprising:

a body comprising a top line, a heel portion, a toe portion, and a sole portion;

a hosel extending up from the heel portion;

a ball striking face supported by the body;

a back portion extending between the heel portion and the toe portion and up from the sole portion, wherein at least part of the back portion is spaced away from a back of the ball striking face to define an undercut in communication with a cavity in a back of the club head;

a plurality of recesses into the back portion; and an insert disposed within at least one of the plurality of recesses, wherein each recess and the insert has a skewed shape comprising planar faces that are not orthogonal to one another, oriented to concentrate a majority of a mass of the insert into a an idealized cylindrical shell coaxial with an axis of rotation of the club head that is vertical when the club head is at address.

4. The club head of claim 3, further comprising a set of inserts of varying densities dimensioned to fit into the recesses.

5. The club head of claim 3, wherein the plurality of recesses comprise two outer recesses flanking two inner recesses, the four recesses being distributed along the back portion.

6. The club head of claim 5, wherein the insert has a parallelepiped shape.

7. The club head of claim 5, wherein the insert is dimensioned to be inserted into the recess into the heel portion and removed and rotated and insert into the recess into the toe portion.

8. The club head of claim 5, wherein the insert is marked with a "T" on one side and an "H" on another side.

9. An iron-type golf club head comprising:

a body comprising a top line, a heel portion, a toe portion, and a sole portion;

a hosel extending up from the heel portion of the body;

a ball-striking face supported by the body;

a back portion extending between the heel portion and the toe portion and up from the sole portion, wherein at least part of the back portion is spaced away from a back of the ball striking face to define an undercut in communication with a cavity in a back of the club head;

at least a first recess and a second recess into the back portion; and a first insert in the first recess and a second insert disposed in the second recess, wherein the first recess and the second recess are skewed in different directions as seen from behind the club head and a shape of an inside of the first recess is a mirror image of a shape of an inside of the second recess.

10. The iron-type golf club head of claim 9, wherein each recess and each insert has a skewed shape comprising planar faces that are not orthogonal to one another.

11. The iron-type golf club head of claim 9, wherein the first recess and the second recess exhibit a chiral relationship to one another.

12. The iron-type golf club head of claim 9, wherein the first recess and the second recess are oriented to concentrate a majority of a mass of each insert into a space defined by an idealized cylindrical shell coaxial with an axis of rotation of the club head that is vertical when the club head is at address.

13. The iron-type golf club head of claim 9, wherein the first insert is dimensioned such that if removed from the first recess it must be rotated to be inserted into the second recess.

* * * * *